US008422909B2

(12) United States Patent
Kabashima

(10) Patent No.: US 8,422,909 B2
(45) Date of Patent: Apr. 16, 2013

(54) DEVELOPING APPARATUS

(75) Inventor: Toru Kabashima, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 436 days.

(21) Appl. No.: 12/695,416

(22) Filed: Jan. 28, 2010

(65) Prior Publication Data

US 2010/0196045 A1 Aug. 5, 2010

(30) Foreign Application Priority Data

Jan. 30, 2009 (JP) ..... 2009-019776

(51) Int. Cl.
*G03G 15/08* (2006.01)

(52) U.S. Cl.
USPC ..... 399/104; 399/277

(58) Field of Classification Search ..... 399/103, 399/104, 276, 277
See application file for complete search history.

(56) References Cited

U.S. PATENT DOCUMENTS 5,812,909 A * 9/1998 Oguma et al. ..... 399/103
6,032,007 A * 2/2000 Yamaji et al. ..... 399/104
7,561,838 B2 7/2009 Sakamaki et al.
2007/0053725 A1 * 3/2007 Sakamaki et al. ..... 399/269
2007/0212123 A1 9/2007 Kabashima

FOREIGN PATENT DOCUMENTS

JP 11-133737 A 5/1995
JP 8-190275 A 7/1996
JP 2007-072222 A 3/2007

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

A developing apparatus includes a developer carrying member for carrying a developer containing magnetic particles; a magnetic member, including first and second magnetic poles which have the same magnetic polarity; a magnetic seal provided opposed to the developer carrying member at a side remote from an image bearing member. The magnetic seal has a third magnetic pole which is most closely opposed to a peak position of the first magnetic pole and which has a magnetic polarity opposite to that of the first magnetic pole, and a fourth magnetic pole which is most closely opposed to a peak position of the second magnetic pole and which has a magnetic polarity opposite to that of the second magnetic pole. Between the third and fourth magnetic poles, the magnetic seal has only one magnetic pole having a polarity opposite to that of the third and fourth magnetic poles.

2 Claims, 23 Drawing Sheets

(AREA 16 IN COMMPARISON Ex.)

DEVELOPING APPARATUS

FIELD OF THE INVENTION AND RELATED ART

The present invention relates to a developing apparatus which develops an electrostatic latent image formed on an image bearing member, such as an electrophotographic photosensitive member, an electrostatically recordable dielectric member, etc., in an image forming apparatus, such as a copying machine, a printer, etc., which uses an electrophotographic image forming method, an electrostatic image forming method, or the like, and a developer which contains magnetic substances.

The developers which contain magnetic substances include magnetic single-component developers (magnetic toners), and two-component developers which contain non-magnetic toner and magnetic carrier.

Here, for the sake of convenience, a developing apparatus will be described with reference to such a developing apparatus that uses a magnetic single-component developer. A developing apparatus has a developer container and a development sleeve. The developer is magnetic single-component developer (which hereafter may be referred to simply as toner). The development sleeve is a developer bearing rotatable member. It bears toner as it is supplied with toner. The development sleeve has a magnet (magnetic member, which hereafter will be referred to as magnetic roller), which is within the development sleeve. The magnetic roller is not rotatable. Some of the toner in the developer container is borne on the peripheral surface of the development sleeve, by being attracted to the peripheral surface of the development sleeve by the magnetic force of the magnetic roller. Thus, as the development sleeve is rotated, the layer of toner on the peripheral surface of the development sleeve is conveyed, by the rotation of the development sleeve, through the gap between the peripheral surface of the development sleeve and a toner layer thickness regulating blade, being thereby controlled in thickness. Thus, a thin layer of toner is formed on the peripheral surface of the development sleeve. Then, the thin layer of toner is conveyed by the subsequent rotation of the development sleeve, to the development area, which is where the peripheral surface of the development sleeve and the peripheral surface of the image bearing member oppose each other. While the developing apparatus is in a developing operation, a preset amount of development bias is applied between the development sleeve and image bearing member to develop an electrostatic latent image. The toner which is remaining on the peripheral surface of the development sleeve after the development, that is, the toner which was not consumed for the development of the electrostatic latent image, is recovered (conveyed back into developer container) by the subsequent rotation of the development sleeve.

By the way, as the development sleeve of an image forming apparatus is increased in rotational speed to increase the image forming apparatus in operational speed, it is possible for the toner on the development sleeve will be scattered away from the development sleeve by centrifugal force. As the toner is scattered, the toner tends to leak out of the developing apparatus, in particular, through the end portions of the developing apparatus in terms of the thrust direction of the development sleeve. This leakage of toner sometimes results in the contamination of recording medium by the toner. Further, as the development sleeve is rotated at a very high speed, the toner is harshly rubbed by the toner layer thickness regulating blade, and this rubbing results in toner deterioration. The toner deterioration results in the formation of an image which is abnormally low in density.

First, the conventional technologies for dealing with the above-described problem, which is attributable to the high speed rotation of the development sleeve, will be described. One of the conventional technologies for dealing with the toner deterioration is Conventional Technology 1 (Patent Document 1: Japanese Laid-open Patent Application H08-190275). Referring to FIG. 20, which is a sectional view of the developing apparatus in accordance with Conventional Technology 1, designated by a referential code 301 is an electrophotographic photosensitive member, as an image bearing member, which is in the form of a drum. The electrophotographic image bearing member 301 is rotationally driven in the clockwise direction indicated by an arrow mark a. As it is rotationally driven, an electrostatic image is formed thereon by an unshown processing means. Designated by a referential code 302 is a developer container, in which magnetic single-component toner 307 is stored. Designated by a referential code 303 is a development sleeve as a developer bearing member. Designated by a referential code 304 is a magnetic roller, which is within the development sleeve 303 and is not rotational. Designated by a referential code 305 is a toner layer thickness regulating blade. Designated by a referential code 306 is a toner supply roller, and designated by a referential code 308 is the shaft of the toner supply roller 306. Designated by a referential code 310 is a toner stirring member. The development sleeve 303 opposes the photosensitive member 301 with the presence of a preset amount of gap between the development sleeve 303 and photosensitive member 301. The area in which the peripheral surface of the development sleeve 303 opposes the peripheral surface of the photosensitive member 301 is a development area A. The magnetic roller 304 has magnetic poles S1, N2, S2, N3, and N1, which are at the predetermined positions on the peripheral surface of the magnetic roller 304, one for one, in the listed order, in terms of the rotational direction of the development sleeve 303. The development sleeve 303 is rotationally driven in the counterclockwise direction indicated by an arrow mark b. The toner supply roller 306 is in contact with the development sleeve 303, and is rotationally driven in the counterclockwise direction indicated by an arrow mark c. As the toner stirring member 310 is rotated, the toner 307 in the developer container 302 is conveyed by the toner stirring member 310 toward the toner supply roller 306 while being stirred. The toner supply roller 306 supplies the development sleeve 303 with the toner 307. The toner layer thickness regulating blade 305 forms the toner 307 on the peripheral surface of the development sleeve 303 into a thin layer. Thus, as the development sleeve 303 is rotated, the thin layer of toner on the development sleeve 303 is conveyed to the development area A, in which the thin layer of toner is used to develop the electrostatic latent image on the photosensitive member 301.

One of the characteristic features of this developing apparatus is the positioning of the magnetic poles of the magnetic roller 304 in the development sleeve 303. More specifically, the magnetic roller 304 is positioned so that the magnetic pole N1 opposes the toner layer thickness regulating blade 305, and also, so that the magnetic pole N3, which is the same in polarity as the magnetic pole N1, is placed on the upstream side of the magnetic pole N1 in terms of the rotational direction of the development sleeve 303. In other words, the magnetic poles N3 and N1, which repel each other, are placed in the adjacencies of the toner layer thickness regulating blade 305. Therefore, as the toner collects in the adjacencies of the toner layer thickness regulating blade 305, it is peeled away by the a toner repelling force generated in the adjacencies of the toner layer thickness regulating blade 305 by the combination of the mutually repelling magnetic poles N1 and N3. With the provision of this structural arrangement, it is unlikely for the toner to be directly conveyed to the toner layer thickness regulating blade 305. In other words, this structural arrangement reduces the amount of pressure to which the toner is subjected, and therefore, the toner is less likely to be deteriorated by the pressure.

On the other hand, there is Conventional Technology 2 (Patent Document 2: Japanese Laid-open Patent Application N11-133737) as a technology for dealing with the scattering of toner. Referring to FIG. 21, which is a sectional view of the development sleeve of the developing apparatus in accordance with Conventional Technology 2, designated by a referential code 110 is an electrophotographic photosensitive member, which is in the form of a drum. The electrophotographic image bearing member 110 is rotationally driven in the counterclockwise direction indicated by an arrow mark a. Designated by referential code 102*e* is a development sleeve, which is rotationally driven in the clockwise direction indicated by an arrow mark b. Designated by a referential code 102*f* is a magnetic roller, which is within the development sleeve 102*e* and is not rotational. Designated by a referential code S101, N101, 5102, and N102 are the magnetic poles of the magnetic roller 102*f*. The magnetic poles S101, N101, S102, and N102 are on the peripheral surface of the magnetic roller 102*f*, in the listed order in terms of the rotational direction of the magnetic sleeve 102*e*. Designated by a referential code 102*d* is a toner layer thickness regulating blade. Further, this developing apparatus is provided with a pair of sealing members 102*g*, which are in the adjacencies of the lengthwise ends of the development sleeve 102*e*, one for one, to prevent the toner from leaking. Each sealing member 102*g* is made of a permanent magnet. Thus, the magnetic force generated between the sealing member 102*g* and stationary magnetic roller 102*f* prevents the toner from leaking.

Further, the positioning of the sealing member 102*g* (which hereafter will be referred to as magnetic seal 102*g*) is such that the magnetic poles of the magnetic seal 102*g* oppose those of the magnetic roller 102*f*, maximizing thereby the amount of force for keeping the toner constrained by the magnetic force. More specifically, for example, the positioning of the sealing member 102*g* is such that the magnetic pole S102 of the magnetic roller 102*f* opposes the magnetic pole N201 of the magnetic seal 102*g*. Shown in FIG. 22 is the magnetic force distribution of the magnetic field, which is an indicator of the distribution of the toner constraining force. Each of the "black round dots" represents a toner particle. Each of the "gray round dots" represents a point where the magnetic field generated between the magnetic roller 102*f* and magnetic seal 102*g* is extremely weak. Each of the "double circles" represents a point with no magnetic force (toner repelling point). It is evident from FIG. 22 that there are points where the magnetic force is strong, that is, points where a large number of toner particles are present, between the magnetic roller 102*f* and magnetic seal 102*g*.

Further, according to Conventional Technology 3 (Patent Document 3: Japanese Laid-open Patent Application 2007-72222), the scattering of toner can be further prevented by strengthening the toner constraining magnetic force by increasing the magnetic seal 102*g* in the number of magnetic poles. FIG. 23 is a sectional view of the development sleeve 102*e*, and its adjacencies, of one of the developing apparatuses in accordance with Conventional Technology 3. In this case, magnetic poles S204 and N204 are between the magnetic poles N201 and S202 of the magnetic seal 102*g*. Thus, a greater number of points which are large in magnetic force are in the adjacencies of the magnetic seal 102*g*, than in the case of the developing apparatus in accordance with Conventional Technology 2, as will be evident from FIG. 24 which shows the magnetic force distribution of this case.

As described above, in the case of Conventional Technologies 2 and 3, the leaking of toner is prevented by providing the magnetic seal with magnetic poles which oppose the magnetic poles of the magnetic roller 102*f* and are opposite in polarity from the magnetic poles of the magnetic roller 102*f*, and also, by providing the magnetic seal with as many magnetic poles as possible which are different in polarity, between the magnetic poles which opposes the magnetic poles of the magnetic roller 102*f*.

However, even when Conventional Technology 1, which reduces toner deterioration by providing a magnetic roller with mutually repelling magnetic poles, was combined with Conventional Technology 2 or 3, toner scattered (leaked). That is, the conventional technologies are problematic in that it is difficult to prevent both the toner deterioration and the scattering of toner (toner leak) by the conventional technologies.

SUMMARY OF THE INVENTION

Thus, the primary object of the present invention, which is related to a developing apparatus having a stationary magnetic roller having mutually repelling magnetic poles, is to provide a magnetic seal structure which can improve a developing apparatus in terms of the sealing of the gaps between the magnetic roller and magnetic seals, in the areas which correspond in position to the interval between the mutually repelling magnetic poles of the magnetic roller.

According to an aspect of the present invention, there is provided a developing apparatus comprising a developer carrying member for carrying a developer containing magnetic particles and for developing a latent image formed on an image bearing member; a magnetic member, provided in said developer carrying member, for magnetic confinement of the developer on a surface of said developer carrying member, wherein said magnetic member has a set of repelling poles including a first magnetic pole and a second magnetic pole which have the same magnetic polarity; and a magnetic seal provided opposed to said developer carrying member at a side remote from said image bearing member, wherein said magnetic seal includes a third magnetic pole and a fourth magnetic pole having a magnetic polarity opposite that of said first magnetic pole at a position opposed to said first magnetic pole and said second magnetic pole, respectively, and includes only one fifth magnetic pole having the same polarity as that of said first magnetic pole.

According to another aspect of the present invention, there is provided the apparatus wherein said sealing member has only one peak of magnetic force between said third magnetic pole and said fourth magnetic pole.

According to a further aspect of the present invention, there is provided the apparatus wherein in a magnetic field provided by said third, fourth and fifth magnetic poles, a magnetic flux density, with respect to a direction toward a center of said magnetic member, at a position of a surface of said magnetic seal member adjacent said fifth magnetic pole is larger than magnetic flux densities, with respect to the direction, at positions of the surface of said magnetic seal member adjacent said third and fourth magnetic poles.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Image Forming Apparatus

Figure 2:
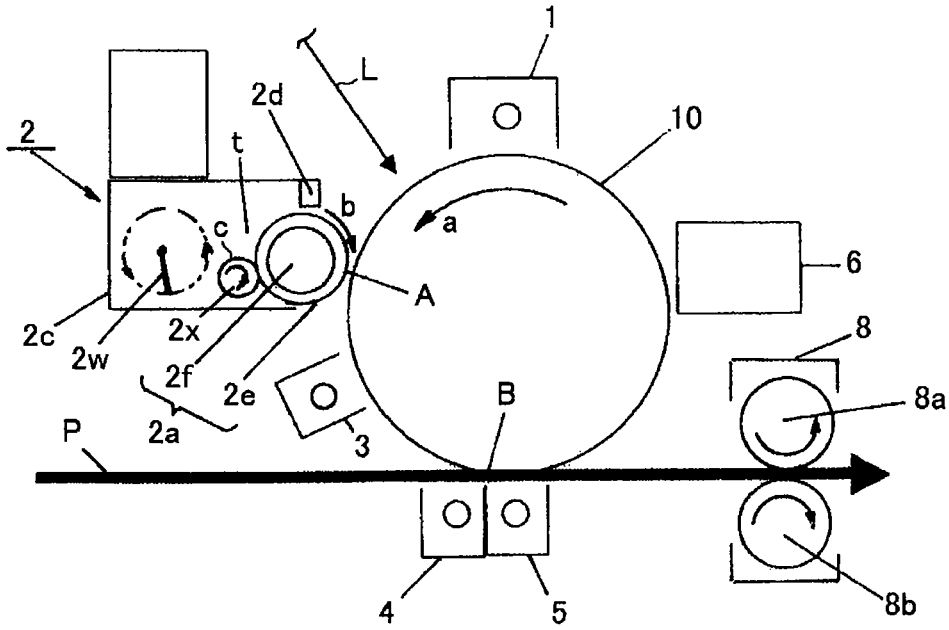
FIG. 2 is a schematic sectional view of the image forming apparatus in the first preferred embodiment of the present invention, and shows the general structure of the image forming apparatus and the general structure of the developing apparatus of the image forming apparatus.

FIG. 2 is a schematic sectional view of the image forming apparatus equipped with an example of a developing apparatus in accordance with the present invention, and shows the general structure of the image forming apparatus and the general structure of the developing apparatus of the image forming apparatus. This image forming apparatus is an electrophotographic image forming apparatus. It has a rotational electrophotographic photosensitive member 10 as an image bearing member (which hereafter will be referred to as photosensitive member 10), which is in the form of a drum, and on which a latent image is formed. More specifically, this photosensitive member 10 is 108 mm in diameter, and is made up of positively chargeable a-Si. It is rotationally driven by a driving apparatus (unshown) in the counterclockwise direction indicated by an arrow mark a, at a preset peripheral velocity (process speed), which is 680 mm/sec in this embodiment. The image forming apparatus has a primary charging device 1, a developing apparatus 2, a pre-transfer charging device 3 (post-development charging device), a transfer charging device 4 (transferring means), a separation charging device 5, and a cleaning apparatus 6 (cleaning means), which are disposed in the listed order, in the adjacencies of the peripheral surface of the photosensitive member 10. The photosensitive member 10 is uniformly charged (primary charge) to +500 V, for example, by the charging device 1. The charged photosensitive member 10 is scanned by a beam of exposing light projected by an exposing apparatus (unshown) at 1,200 dpi (exposure by beam of laser light). As a result, an electrostatic latent image, which reflects the inputted information of the image to be formed, is formed on the peripheral surface of the photosensitive member 10. The electrostatic latent image is developed into a visible image, that is, an image formed of toner (developer), by the developing apparatus 2, in the development area A. The details of the developing apparatus 2 will be described in the following section (Section 2).

After the development, the peripheral surface of the photosensitive member 10 is charged (pre-transfer charge) by the pre-transfer charging device 3, and then, reaches the transfer area B, which is where the peripheral surface of the photosensitive member 10 opposes the transfer charging device 4. Meanwhile, a transfer medium P (recording medium), such as a sheet of paper, is conveyed from a recording medium feeding-and-conveying portion (unshown) to the transfer area B with such timing that the transfer medium P will arrive at the transfer area B in synchronism with the arrival of the pre-transfer charged portion of the peripheral surface of the photosensitive member 10 at the transfer area B. Then, the toner image on the photosensitive member 10 is transferred onto the transfer medium P by the transfer charging device 4 to which a transfer bias, which is opposite in polarity from the toner image, is being applied. After the transfer of the toner image onto the transfer medium P, the transfer medium P is separated from the photosensitive member 10 by the separation charging device 5. Then, the transfer medium P is conveyed to a fixing apparatus 8, which is made up of a fixation roller 8*a* and a pressure roller 8*b*. As the transfer medium P arrives at the fixing apparatus 8, it is conveyed through the fixation nip between the fixation roller 8*a* and pressure roller 8*b*. As it is conveyed through the fixation nip, the toner image on the recording medium P is fixed to the transferred medium P by the heat and pressure from the fixation roller 8*a* and pressure roller 8*b*.

The transfer residual toner, that is, the toner remaining on the peripheral surface of the photosensitive member 10 after the transfer of the toner image onto the transfer medium P, is removed and recovered by the cleaning apparatus 6. After the cleaning of the peripheral surface of the photosensitive member 10 by the cleaning apparatus 6, the peripheral surface of the photosensitive member 10 is repeatedly used for image formation.

(2) Developing Apparatus

The developing apparatus 2 is such a developing apparatus that develops an electrostatic latent image on the peripheral surface of the photosensitive member 10, with the use of a developer t (magnetic single-component toner, which hereafter will be referred to simply as toner), which in this embodiment is a magnetic single-component developer, each particle of which contains a magnetic substance. The developing apparatus 2 has: a developer container 2*c* which contains the toner; and a development sleeve 2*e*, which is a developer bearing rotatable member, and which bears the toner as it is supplied with the toner. The developing apparatus 2 has also a magnetic member 2*f* (member made of magnetic substance), which is within the development sleeve 2*e*. The magnetic member 2*f* is disposed in the development sleeve 2*e*, and does not rotate. It keeps the toner t magnetically held to the peripheral surface of the development sleeve 2*e*. That is, there is the stationary permanent magnet 2*f* (which hereafter will be referred to as magnetic roller) in the development sleeve 2*e*. The development sleeve 2*e* rotates around the magnetic roller 2*f*, the axis of which coincides with the rotational axis of the development sleeve 2*e*.

Hereafter, the combination of the above-described development sleeve 2*e* and magnetic roller 2*f* will be referred to as the development roller 2*a*.

The development roller 2*a* is parallel to the photosensitive member 10, with the presence of a preset amount of gap between the development roller 2*a* and photosensitive member 10. The area in which the peripheral surface of the development roller 2*a* opposes to the peripheral surface of the photosensitive member 10 is the development area A. The development sleeve 2*e* is rotationally driven in the clockwise direction indicated by an arrow mark b, at a preset peripheral velocity, by a driving apparatus (unshown). That is, the development sleeve 2*e* is rotationally driven so that the direction in which its peripheral surface moves in the development area A becomes the same as the direction in which the peripheral surface of the photosensitive member 10 moves in the development area A.

The toner t in the developer container 2*c* is conveyed toward the toner supply roller 2*x* (elastic sponge roller) by the rotation of a toner stirring member 2*w*, while being stirred by the stirring member 2*w*. The toner supply roller 2*x* is rotationally driven in the clockwise direction indicated by an arrow mark c while remaining in contact with the development sleeve 2*e*. That is, the toner supply roller 2*x* supplies the development sleeve 2*e* with the toner t by being driven so that the direction in which its peripheral surface moves in the area of contact between it and development sleeve 2*e*, becomes opposite to the direction in which the peripheral surface of the development sleeve 2*e* moves in the area of contact between it and development sleeve 2*e*.

The supplied toner t is attracted to the peripheral surface of the development sleeve 2*e* by the magnetic force of the magnetic roller 2*f*, and magnetically held to the peripheral surface of the development sleeve 2*e* by being constrained by the magnetic force. Then, as the development sleeve 2*e* is rotated, the toner on the peripheral surface of the development sleeve 2*e* is conveyed toward the development area A while being regulated in the thickness of the layer it forms on the peripheral surface of the development sleeve 2*e*, by the toner layer thickness regulating blade 2*d* (which hereafter will be referred to simply as regulation blade 2*d*) which opposes the peripheral surface of the development sleeve 2*e* with the presence of a preset amount of gap between the regulating edge of the regulation blade 2*d* and the peripheral surface of the development sleeve 2*e* (jumping developing method). Thus, a thin layer of toner t is formed on the peripheral surface of the development sleeve 2*e*. The thin layer of toner t is conveyed to the development area A by the subsequent rotation of the development sleeve 2*e*. During a development operation, a preset development bias (combination of DC and AC), which is the same in polarity as the polarity to which the photosensitive member 10 was charged, is applied to the development sleeve 2*e*. Thus, the development sleeve 2*e* causes the toner t, which is opposite in polarity to the photosensitive member 10, to adhere to the peripheral surface of the photosensitive member 10 (points of electrostatic latent image, which were reduced in potential). Consequently, the electrostatic latent image becomes a visible image formed of the toner.

Incidentally, the developing apparatus 2 in this embodiment may be replaced by a developing apparatus structured so that it does not require the toner supply roller 2*x*.

Figure 1:
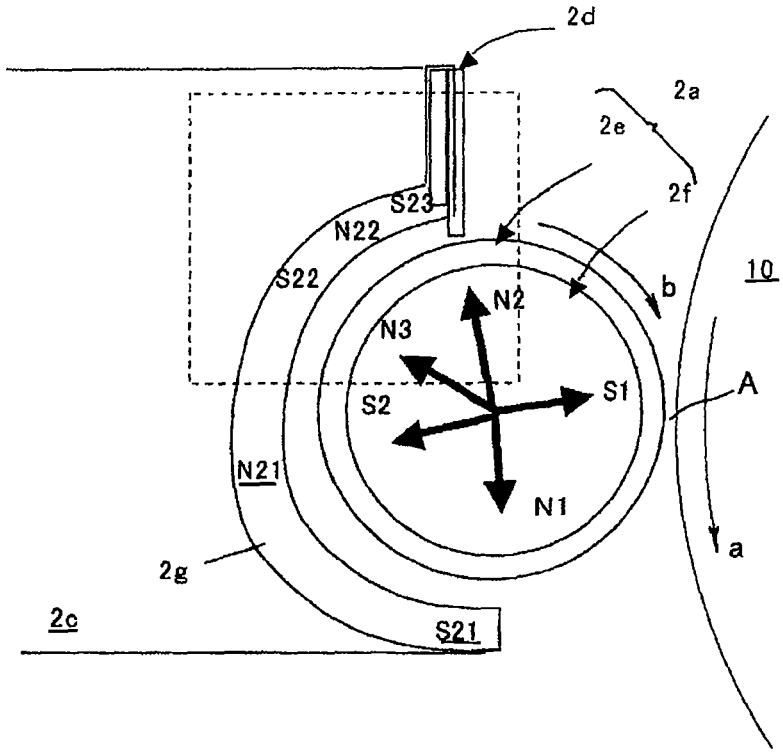
FIG. 1 is a schematic sectional view of the essential portions of the developing apparatus in the first preferred embodiment of the present invention.

FIG. 1 is an enlarged schematic cross-sectional view of the essential portions of the above-described developing apparatus 2. The magnetic roller 2*f* has magnetic poles S1, N1, S2, N3, and N2, listing in the order of their positions in terms of the rotational direction of the development sleeve 2*e*. That is, the magnetic roller 2*f* has multiple magnetic poles, which are positioned so that at least two magnetic poles which are the same in polarity are next to each other. The toner t in the developer container 2*c* is attracted to the peripheral surface of the development sleeve 2*e* by the magnetic force of the magnetic pole N2, and the amount by which it is allowed to remain on the peripheral surface of the development sleeve 2*e* is regulated by the regulation blade 2*d*. The toner particles (t) on the peripheral surface of the development sleeve 2*e* are made to fly to the peripheral surface of the photosensitive member 10 by the developmental magnetic pole S1. The toner particles, which did not adhere to the peripheral surface of the photosensitive member 10, are pulled back onto the peripheral surface of the development sleeve 2*e* by the magnetic pole N1, and remain adhered to the peripheral surface of the development sleeve 2*e* by the magnetic pole S2. Then, they are stripped away from the peripheral surface of the development sleeve 2*e* by the magnetic force from the magnetic pole N3, and the magnetic force from the magnetic pole N2, which repel each other. The stripped toner particles fall back into the developer container 2*c*.

Figure 3:
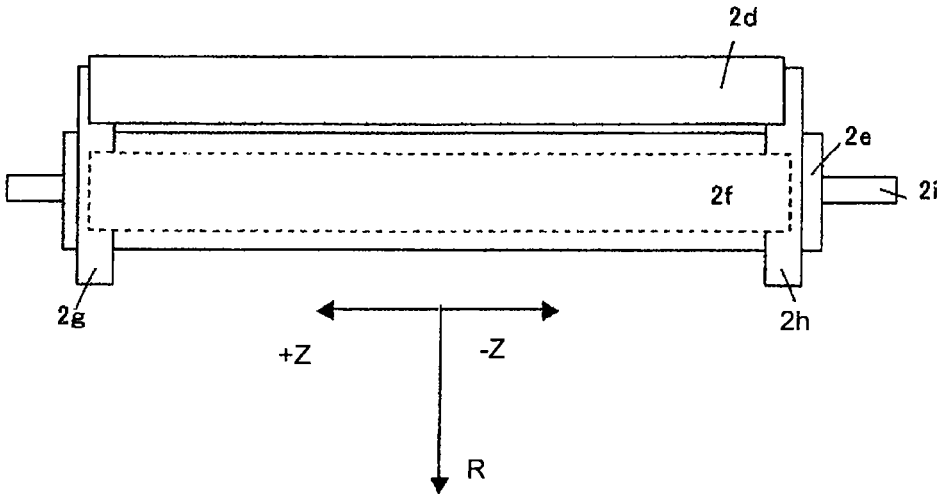
FIG. 3 is a schematic drawing for showing the positioning of the developing apparatus components in terms of the thrust direction of the development sleeve.

The developing apparatus 2 is provided with a pair of sealing members 2*g* and 2*h*, which are near the lengthwise end portions of the development sleeve 2*e*, one for one, to prevent the toner t from leaking. FIG. 3 is a schematic drawing for showing the positioning of the developing apparatus components in terms of the thrust direction of the development sleeve. The sealing members 2*g* and 2*h* are permanent magnets (magnetic seals). Their magnetic force works with the magnetic force of the magnetic roller 2*f* to prevent the toner from scattering (leaking). The sealing members 2*g* and 2*h* (which hereafter will be referred to as magnetic seals) are solidly attached to the opposite side of the developer container 2*c* from the photosensitive member 10, with the provision of preset distance from the peripheral surface of the development roller 2*a*. That is, the magnetic seals 2*g* and 2*h* are solidly attached to developer container 2*c* so that they are near the lengthwise ends of the magnetic roller 2*f*, one for one, and also, so that they face the opposite side of the photosensitive member 10 from where the peripheral surface of the development sleeve 2*e* faces the peripheral surface of the photosensitive member 10. In this embodiment, the magnetic seals 2*g* and 2*h* are positioned so that they overlap with the lengthwise end portions of the magnetic roller 2*f*, one for one, in terms of the radius direction of the magnetic roller 2*f*. Designated by a referential code 2*i* is a magnetic roller shaft (center axle of magnetic roller 2*f*).

The magnetic seals 2*g* and 2*h*, which are near the lengthwise ends of the development sleeve 2*e* (developing apparatus 2), one for one, are the same in the magnetic pole placement pattern. Thus, the magnetic pole placement pattern, which is one of the characteristic features of the magnetic seals 2*g* and 2*h*, will be described with reference to primarily the magnetic seal 2*g*, referring to FIG. 1. The magnetic poles of the magnetic seal 2*g* are positioned so that after the positioning of the magnetic seal 2*g* in the developing apparatus 2, they oppose the magnetic poles of the magnetic roller 2*f*. For example, the magnetic pole S23 of the magnetic seal 2*g* is positioned so that it opposes the magnetic pole N2 of the magnetic roller 2*f*, and the magnetic pole S22 of the magnetic seal 2*g* is positioned so that it opposes the magnetic pole N3 of the magnetic roller 2*f*. Another characteristic feature of the magnetic seal 2*g* is that its magnetic pole N22, which is the same in polarity as the magnetic poles N3 and N2 of the magnetic roller 2*f*, which are mutually repelling poles, is positioned so that its position corresponds to a point between the magnetic poles N3 and N2 of the magnetic roller 2*f*. That is, the magnetic roller 2*f* has multiple magnetic poles including a pair of mutually repelling poles (N3 and N2, for example) positioned next to each other, whereas the magnetic seal 2*g* (2*h*) has the magnetic poles S22 and S23, which are opposite in polarity to the abovementioned magnetic poles N3 and N2 (which are mutually repelling poles) and are positioned to oppose the magnetic poles N3 and N2, and at least one pole (N22), which is positioned to oppose the point between the mutually repelling magnetic poles N3 and N2, and this magnetic pole is the same in polarity as the mutually repelling magnetic poles N3 and N2.

First, the structural arrangement for a developing apparatus, which does not place the magnetic pole N22, which is the same in polarity as the mutually repelling magnetic poles N3 and N2 of the magnetic roller 2*f*, in a position which opposes a point between the mutually repelling magnetic poles N3 and N2 of the magnetic roller 2*f*, will be described as a comparative structural arrangement.

Figure 4:
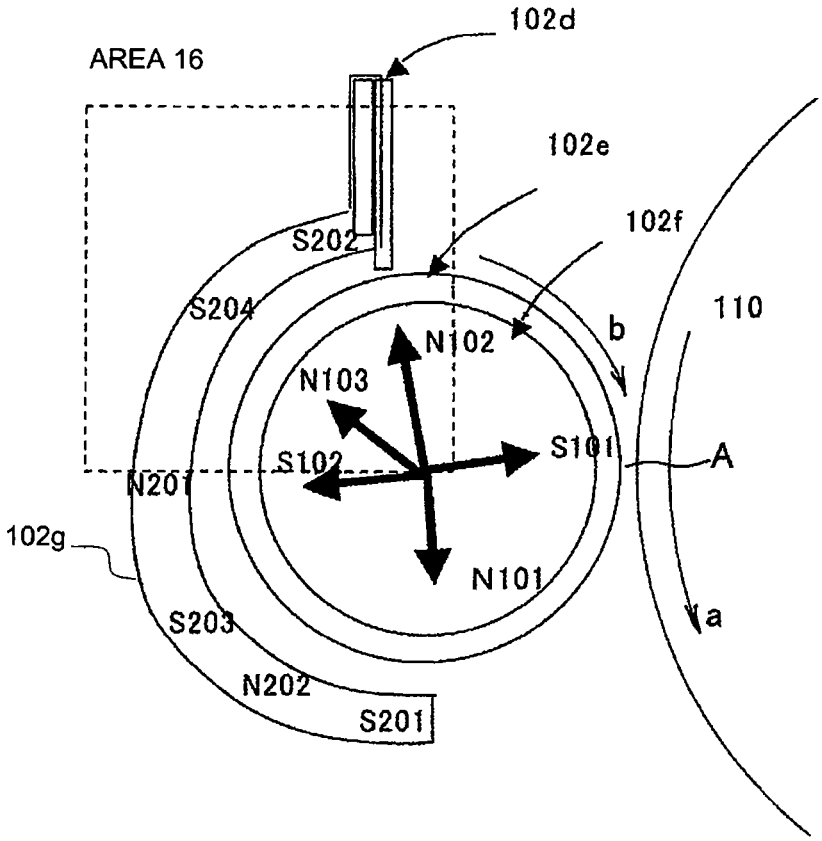
FIG. 4 is a schematic sectional view of the essential portions of the first comparative example of conventional developing apparatus.
Figure 5:
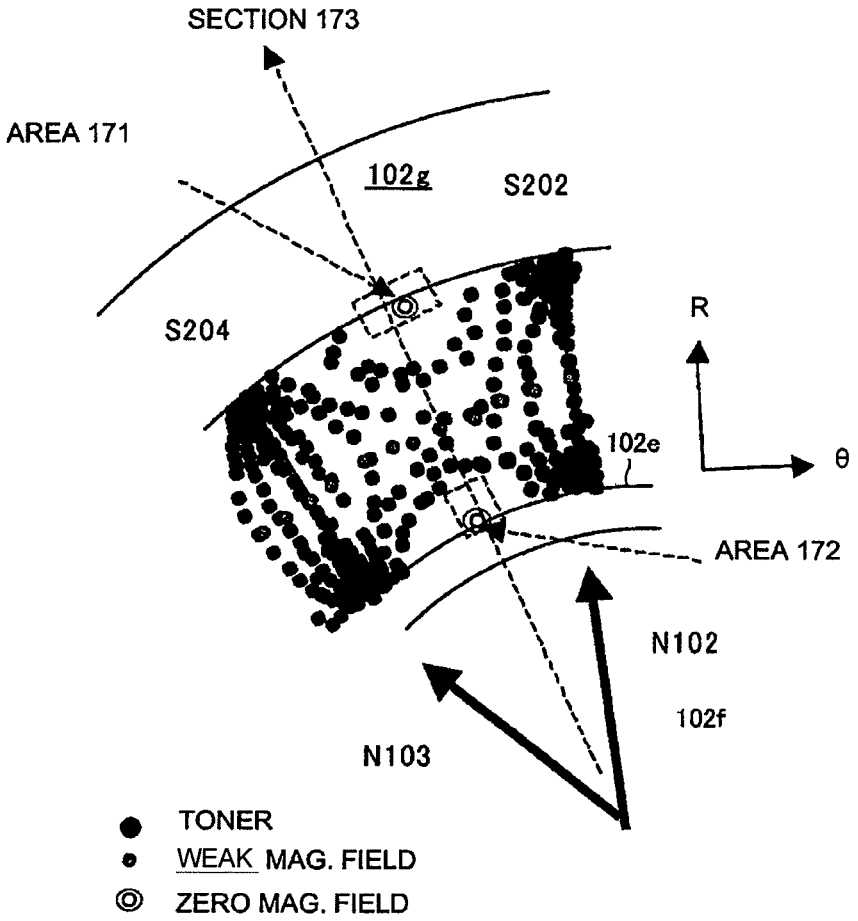
FIG. 5 is a schematic drawing showing the magnetic force distribution of the magnetic field (area 16) of the first comparative developing apparatus.

Shown in FIG. 4 is a magnet pole placement pattern (comparative pattern 1) in which magnetic poles different in polarity are positioned based on the conventional manner. In this case, the magnetic poles of the magnetic seal 102*g*, which oppose the mutually repelling magnetic poles N103 and N102 of the magnetic roller 102*f*, one for one, are the magnetic poles S204 and S202, which are opposite in polarity to the magnetic poles N103 and N102, respectively. Next, the distribution of the magnetic force in this setup will be examined. FIG. 5 shows the magnetic force distribution of the magnetic field created by the mutually repelling magnetic poles N103 and N102 in the adjacencies (area 16) of the regulation blade 102*d*. A direction R which is parallel to the plane of the FIG. 5 is perpendicular to the plane which is tangential to the peripheral surface of the magnetic roller 102*f*. A direction θ is tangential to the peripheral surface of the magnetic roller 102*f*. "Black dots" between the magnetic roller 102*f* and magnetic seal 102*g* represent toner particles. "Grey circles" between the magnetic roller 102*f* and magnetic seal 102*g* represent points where the magnetic force is extremely weak. "Double-circles" between the magnetic roller 102*f* and magnetic seal 102*g* represent points where the magnetic force is zero (there is no magnetic field), that is, the points of repellence. In other words, a magnetic field where the magnetic force which acts on the toner particles in the direction R, and the magnetic force which acts on the toner particles in the direction θ, that is, the points (areas) with no magnetic force, are created. That is, in a case where the adjacent magnetic poles S202 and S204 of the magnetic seal 102*g* are the same in polarity, an area in which magnetic force is virtually zero is created between the magnetic poles S202 and S204 on the surface of the magnetic seal 102*g*. In other words, in this area, there is no force which acts on the toner particles. Therefore, the toner leaks through this area, which is next to the surface of the magnetic seal 2*g*.

Figure 6:
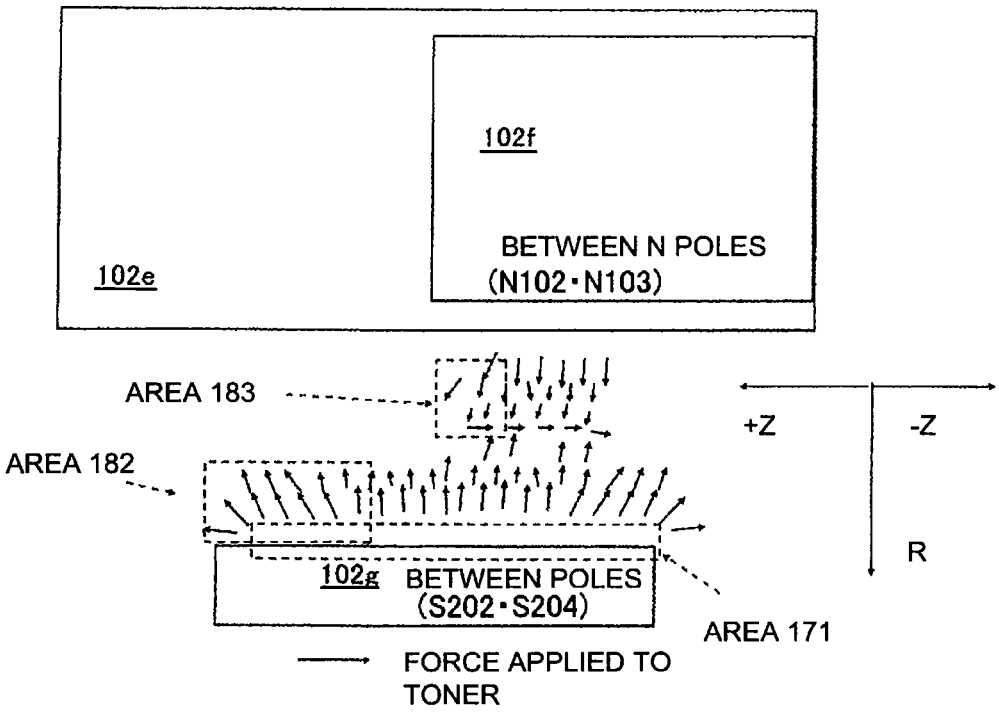
FIG. 6 is a drawing showing the distribution of the magnetic force which acts on the toner in the direction parallel to the thrust direction of the development sleeve of the first comparative developing apparatus.

Next, what kind of force acts on the toner particles in an area which is in the adjacencies of the lengthwise end portions (at plane 173) of the magnetic roller 102*f* in terms of the thrust direction of the magnetic roller 102*f*, and through which toner is likely to leak, will be investigated. Shown in FIG. 6 is the distribution of the magnetic force in one of the lengthwise end portions (in terms of thrust direction) of the first comparative developing apparatus. To pay attention, first, to the surface of the magnetic seal 102*g*, there is an area 182 in which the magnetic force acts on the toner particles in the outward direction (outward of developer container). Thus, the toner particles are made to leak by the magnetic force, through the area 182, which is between the mutually repelling magnetic poles S202 and S204 of the magnetic seal 102*g*. There is also an area 171, on the surface of the magnetic seal 102*g*, which has points where no toner particle is present. Next, examining the space between the magnetic roller 102*f* and magnetic seal 102*g*, it is evident that in the area 183, the magnetic force acts on the toner particles in the outward direction, because of the effects of the force from the magnetic roller 102*f* and the local magnetic field created by the mutually repelling magnetic poles of the magnetic seal 102*g*. Thus, it is evident that combining the magnetic roller 102*f* which has the mutually repelling magnetic poles N102 and N103, with the magnetic seal 102*g* which has the magnetic poles S202 and S204, which are opposite in polarity to the magnetic poles N102 and N103 of the magnetic roller 102*f*, based on the conventional technological thinking, allows the toner to leak and scatter through multiple points (areas).

Figure 7:
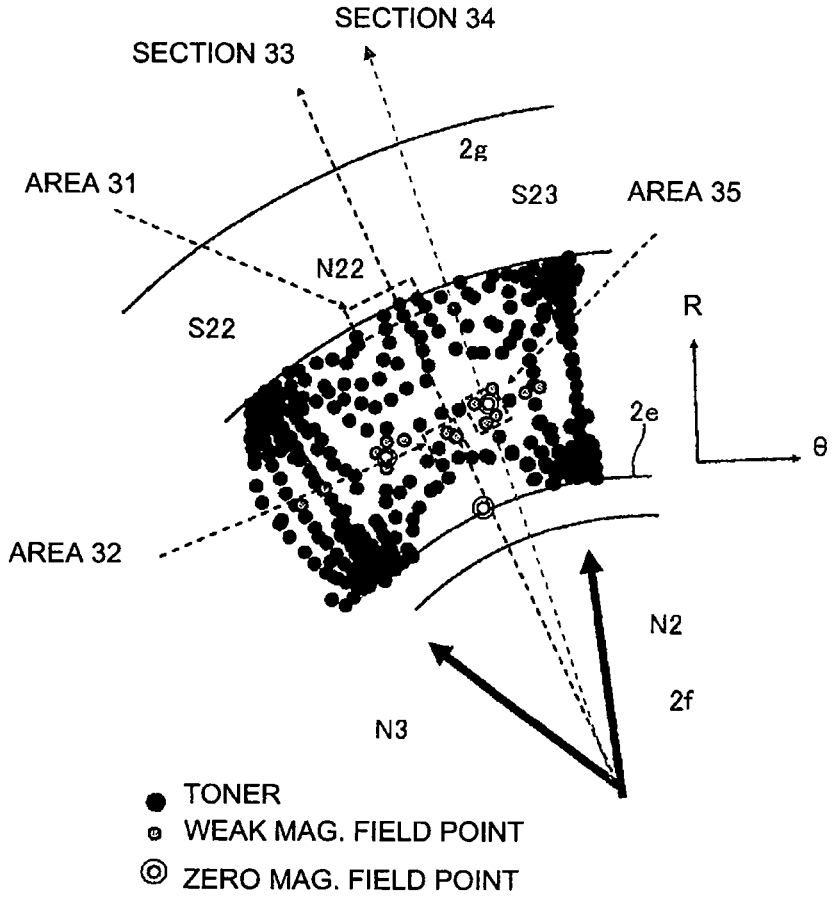
FIG. 7 is a drawing of the magnetic force distribution of the magnetic field of the developing apparatus in the first preferred embodiment of the present invention.

Given next is the comparison of the magnetic pole placement pattern in accordance with the conventional technology, with the magnetic pole placement pattern of the magnetic seal 2*g* in the first preferred embodiment of the present invention. FIG. 7 shows the magnetic force distribution of the magnetic field in the first preferred embodiment. An area 32 is where the magnetic field of the magnetic pole S22 and the magnetic field of the magnetic pole N2 are weak, and also, where the magnetic field of the magnetic pole S23 and the magnetic field of the magnetic pole N3 are weak. An area 35 is where the magnetic poles N22 and N2 repel each other, and therefore, no magnetic field is present. The magnetic pole with which the magnetic seal 2*g* is provided between its magnetic poles S23 and S22 is only a magnetic pole N22, which is opposite in polarity to the magnetic poles S23 and S22. Placing only the magnetic pole N22, which is opposite in polarity to the magnetic poles S23 and S22, between the magnetic poles S23 and S22 means the following. That is, only the magnetic pole N2 is positioned between the magnetic poles S23 and S22 so that there is only a single magnetic force peak between the magnetic poles S23 and S22. In this case, where the magnetic pole N22 is placed does not needs to be a specific point between the magnetic poles S23 and S22. In other words, all that is necessary is that the magnetic pole N2 is in a specific range between the magnetic poles S23 and S22. However, the magnetic pole N2 has to be positioned so that there is only one magnetic force peak within the range in which the magnetic pole N2 is placed. Consequently, an area 31 on the surface of the magnetic seal 2*g* has no point where the magnetic force strength is zero. Therefore, the toner particles remain constrained to the area 31, and therefore, the toner particles are less likely to scatter. On the other hand, an area 35 has two points where the magnetic force strength is zero. However, the direction of the magnetic force in terms of the direction parallel to the thrust direction of the magnetic roller 102*f*, is likely to be inward of the developer container 2*c*, as will be described later. Therefore, the toner particles are unlikely to scatter (leak).

Figure 8:
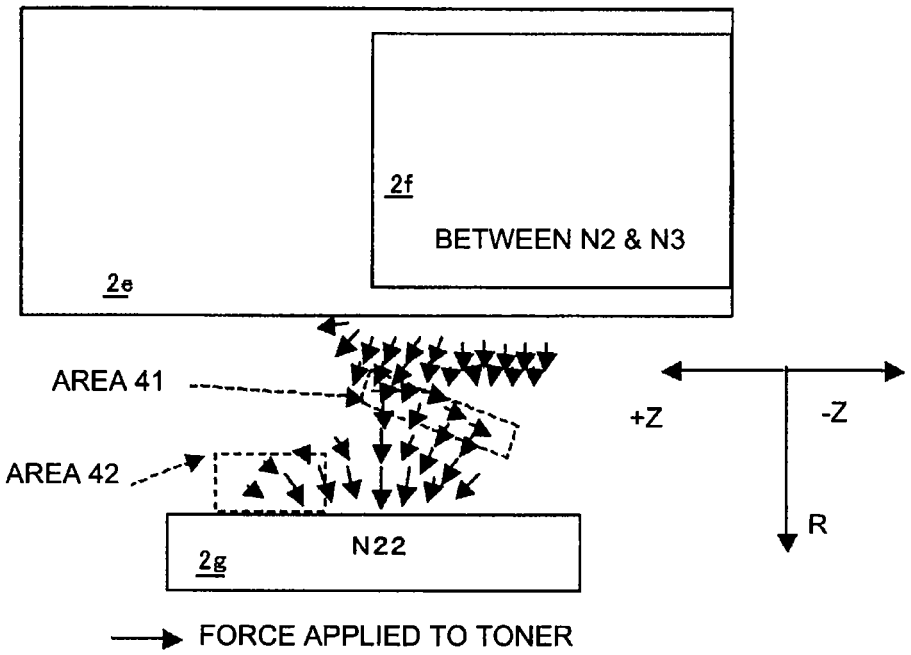
FIG. 8 is a drawing showing the distribution of the magnetic force which acts on the toner in the direction parallel to the thrust direction of the development sleeve of developing apparatus in the first preferred embodiment of the present invention.

Given next is the comparison of the magnetic force between the magnetic seal 2*g* and magnetic roller 2*f* in this preferred embodiment, with the magnetic force between the magnetic seal and magnetic roller in accordance with the conventional technological thinking. FIG. 8 shows the magnetic force distribution on a plane parallel to the thrust direction of the development sleeve (at sectional plane 33 in FIG. 7), in the first preferred embodiment. First, attention is paid to the surface of the magnetic seal 2*g*. It is evident from FIG. 8 that in an area 42, the magnetic force which acts on the toner particles is directed toward the magnetic seal 2*g*. Therefore, compared to the toner particles in the comparative developing apparatus, it is more difficult for the toner particles in this developing apparatus to scatter (leak). In an area 41, the magnetic force which is directed outward (outward of developer container) in the comparative developing apparatus, is directed toward the developer container 2*c* (inward of developer container), by the magnetic force from the magnetic seal 2*g*. That is, in the first preferred embodiment, the scattering (leaking) of the toner is prevented by directing the magnetic force which acts on the toner particles, inward of the developer container 2*c*, unlike the conventional technological thinking. The results of the tests carried out to verify the actual level of the scattering of the toner particles are shown in Table 1.

TABLE 1

| | Mag. Roll Ptrns (Rplg) | Mag. Seal Ptrns | Mag. Pole of Mag. Seal opposed to Repelling Pole of Mag. Roll | Mag. pole of Mag. Seal opposed to between Repelling Poles of Mag. Roll | Mag. flux Density with respect to R. direct'n (mT) | Evaluation (Toner Scatter at k shs) |
|---|---|---|---|---|---|---|
| Emb. 1 | NN | SNS | S22, S23 | N22 | 80 | 330 |
| Comp. Ex. 1 | NN | SS | S204, S202 | NOTHING | 80 | 1.5 |
| Comp. Ex. 2 | NN | SNSNS | S22, S23 | N22, S24, N23 | 80 | 13 |
| Comp. Ex. 3 | NN | SSS | S204, S202 | S205 | 80 | 0.6 |
| Comp. Ex. 4 | NN | SNSNSNS | S22, S23 | N22, S24, N23, S25, N24 | 80 | 7 |

In Table 1, the column named "magnetic pole placement pattern of magnetic roller" shows mutually repelling magnetic poles, and the column named "magnetic pole placement pattern of magnetic seal" shows the order in which the magnetic poles which oppose the mutually repelling poles of the magnetic roller, one for one, and the magnetic pole which opposes the area between the mutually repelling poles of the magnetic roller, are disposed.

The conditions of the tests are as follows. The environment in which the tests were carried out was 23° C. in temperature and 50% in humidity. The image chart ratio is 5% (size A4). The amount of toner in the developer container 2*c* was 500 to 600 g. The development contrast was adjusted so that the amount of toner on the photosensitive member 10 became 0.6 mg/cm$^2$. The sheets of recording medium were continuously fed at a rate of 130 ppm. Then, the number of copies made before the toner began to scatter (leak) from the lengthwise (thrust) end portions of the development sleeves, was counted.

The magnetic flux density of the magnetic roller 102*f*, and that of the magnetic seal 2*g*, were kept stable at 80 mT. The gap between the development sleeve 2*e* and magnetic seal 2*g* was 0.75 mm. The toner was magnetic singe-component toner, and was 1.65 in relative magnetic permeability. As for the rotational velocity, the photosensitive member 10 was 700 mm/s, and development sleeve 2*e* was 800 mm/s. The gap between the regulation blade 2*d* and development sleeve 2*e* was 0.2 mm.

In the case of the first comparative example of a developing apparatus, the toner began to scatter (leak) when the cumulative number of the recording medium sheets reached roughly 1,500. On the other hand, in the case of the image forming apparatus 2 in this (first) preferred embodiment, the toner did not begin to scatter until the cumulative number of the recording medium sheets reached roughly 330,000. That is, the effect of the application of the present invention was drastic; the present invention was 250 times more effective than the conventional technological thinking. In other words, in a case where the magnetic roller 2*f* is provided with a pair of mutually repelling poles which are next to each other, the amount by which the toner scatters from the lengthwise ends of the development sleeve 2*e* can be reduced by providing the magnetic seal 2*g* with a magnetic pole which is the same in polarity as the pair of mutually repelling poles of the magnetic roller 2*f* and opposes a point of the magnetic roller 2*f*, which is between the pair of mutually repelling poles of the magnetic roller 2*f*.

Figure 9:
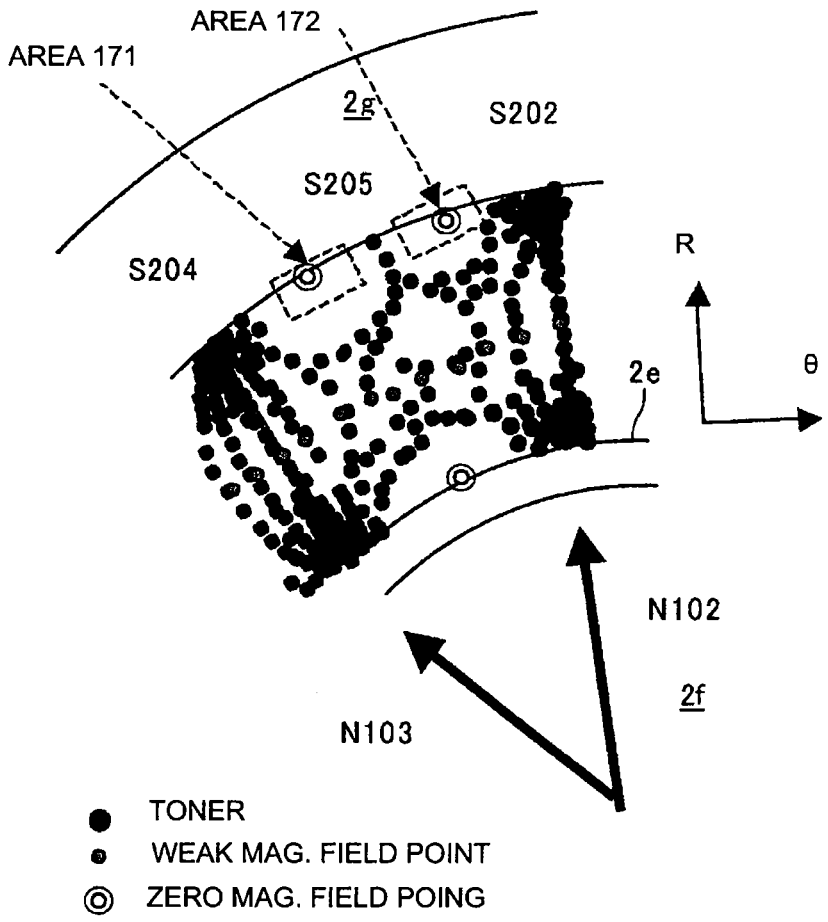
FIG. 9 is a drawing of the magnetic force distribution of the magnetic field of the third comparative developing apparatus.

Next, referring to FIG. 9, the third comparative example of a developing apparatus, that is, the case in which the magnetic seal 2*g* was provided with a magnetic pole S205, which is the same in polarity as the pair of magnetic poles S204 and S202 of the magnetic seal 2*g*, and opposes a point between the pair of magnetic poles S204 and S202, will be described. The magnetic seal 2*g* was provided with the magnetic pole S204, which opposes the magnetic pole N103 of the magnetic roller 2*f*, and the magnetic pole S202 which opposes the magnetic pole N102 of the magnetic roller 2*f*. Further, the magnetic seal 2*g* was provided the magnetic pole S205 which was the same in polarity as the magnetic poles S204 and S202 and was positioned to oppose a point between the magnetic poles S204 and S202. As a result, two points (two areas 171 and 172) which are zero in the amount of magnetic force were formed on the inward surface of the magnetic seal 2*g*. As in the case of the first comparative example of a developing apparatus, the greater the magnetic seal 2*g* in the number of points (areas) where the amount of the magnetic force is zero, the lower the magnetic seal 2*g* in the amount of toner constraining force, and therefore, the easier the toner to scatter (leak). The test results of the third comparative example of a developing apparatus are shown in the third row of Table 1. As for the evaluation of the actual tests, the toner began to scatter after the completion of roughly 6,000 copies. That is, compared to the first comparative example of a developing apparatus which has only one zero-magnetic force point, the test results of this comparative developing apparatus was worse by roughly ½. Further, the amount of the toner constraining magnetic force was 1/660 of that of the developing apparatus in the first preferred embodiment.

As described above, in a case where a magnetic roller is provided with mutually repelling magnetic poles which are next to each other, this (first) preferred embodiment, in which a magnetic seal is provided with a magnetic pole, which is the same in polarity as the mutually repelling magnetic poles of the magnetic roller, and faces a point of the magnetic roller, which is between the mutually repelling magnetic poles, is most effective to prevent the toner from scattering, unlike the conventional technological thinking.

Figure 10:
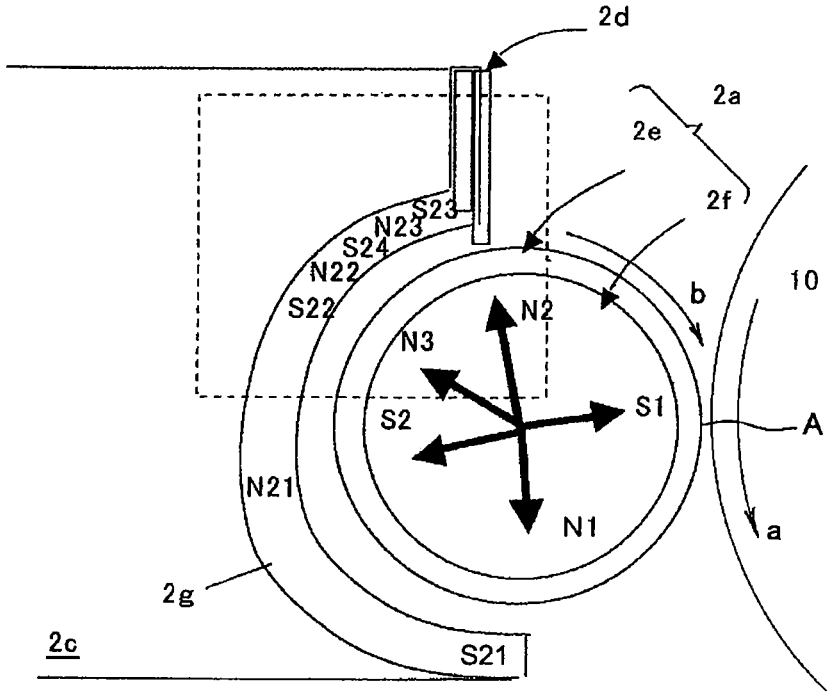
FIG. 10 is a schematic sectional view of the essential portions of the second comparative developing apparatus.
Figure 11:
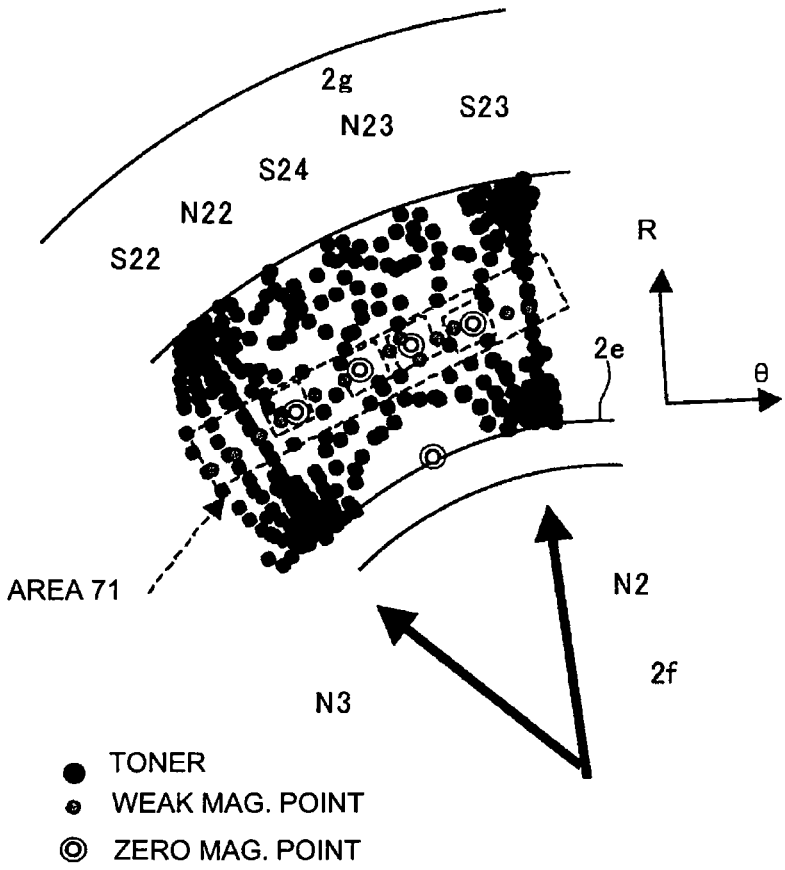
FIG. 11 is a drawing of the magnetic force distribution of the magnetic field of the second comparative developing apparatus.

Next, the developing apparatus design in the first preferred embodiment will be compared with the developing apparatus design proposed by the conventional technologies. FIG. 10 is a schematic sectional view of the essential portions of the second comparative developing apparatus. In the case of this developing apparatus, the magnetic seal is provided multiple magnetic poles, in addition to the magnetic poles which face the mutually repelling magnetic poles of the magnetic roller. The additional magnetic poles are between the mutually repelling magnetic poles of the magnetic seal, and are opposite in polarity to the mutually repelling magnetic poles of the magnetic roller. More specifically, the magnetic seal 2*g* is provided with the magnetic poles S22 and S23, which face the magnetic poles N3 and N2, respectively, of the magnetic roller 2*f*. Further, the magnetic seal 2*g* is provided with magnetic poles N22, S24, and N23, which are between the magnetic poles S22 and S23 of the magnetic seal 2*g*, as in the case of a developing apparatus in accordance with the conventional technological thinking. The magnetic force distribution of this developing apparatus is shown in FIG. 11. Compared to the developing apparatus in the first preferred embodiment, this developing apparatus is greater in the number of the zero-magnetic force points and low magnetic force points between the magnetic roller 2*f* and magnetic seal 2*g* (area 71). As for the actual count, the number of the points where the toner is likely to scatter is greater by four. This occurs because this developing apparatus is greater in the number of points where the magnetic poles are magnetically in connection with each other. The results of the tests are given in the row of the comparative example 2 in Table 1. In the case of the second comparative example, in which three magnetic poles, that is, magnetic poles N22, S24, and N23, were between the magnetic poles S22 and S23, the toner began to scatter after roughly 13,000 sheets of recording medium were conveyed. In other words, the second comparative example of a developing apparatus lasted only one 20th as long as of the developing apparatus in the first preferred embodiment which had only one magnetic pole N22, which was between the magnetic poles S22 and S23.

Figure 12:
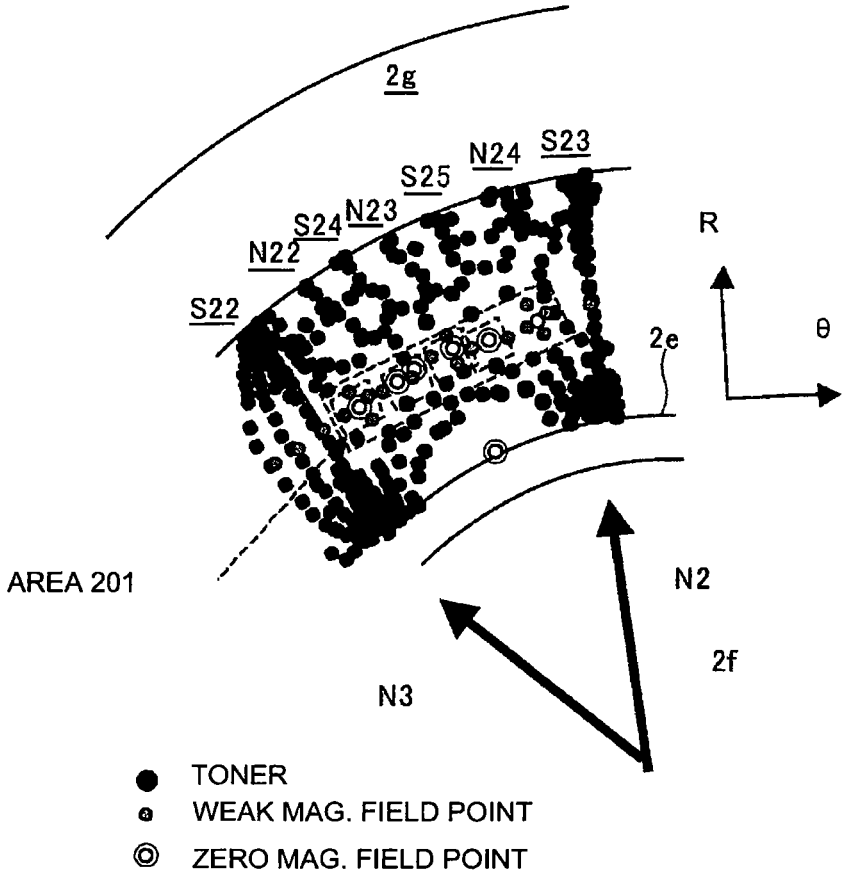
FIG. 12 is a drawing of the magnetic force distribution of the magnetic field of the fourth comparative developing apparatus.

FIG. 12 is a drawing of the magnetic force distribution of the magnetic field of a developing apparatus in which five magnetic poles N22, S24, N23, S25, and N24 are between the magnetic poles S22 and S23 of the magnetic seal 2*g*. As will be evident by viewing FIG. 12, in this case, there are even more zero-magnetic force points between the magnetic roller 2*f* and magnetic seal 2*g*, and low magnetic force points which are in the adjacencies of the zero-magnetic force points (area 201). The data from the tests are given in the row for the fourth comparative example, in Table 1. In the case of the fourth comparative developing apparatus, the toner began to scatter after 7,000 sheets of recording medium were conveyed through the developing apparatus. In other words, the fourth comparative developing apparatus lasted only 1/50 as long as the developing apparatus in the first preferred embodiment. That is, the greater the number of magnetic poles between the magnetic poles S22 and S23, the greater the number of points which magnetically connect with the mutually repelling magnetic poles S22 and S23, and therefore, the worse the scattering of toner.

As described above, in order to reduce the scattering of toner, it is important to reduce as much as possible the number of zero-magnetic-force points (repel points) between the development sleeve and magnetic seal. As the means for reducing as much as possible the number of zero-magnetic-force points between the development sleeve and magnetic seal, it is most effective to reduce the magnetic seal as much as possible in the number of magnetic poles. That is, in a case where the magnetic roller does not have the mutually repelling poles which are next to each other, the magnetic force differently behaves from how it behaves in a case where the magnetic roller has mutually repelling poles which are next to each other. Thus, it is reasonable to say that in a case where the magnetic roller has mutually repelling poles which are next to each other, the idealistic number of the magnetic poles of the magnetic seal, which oppose a point between the mutually repelling poles of the magnetic roller is one.

The relationship between the number of zero-magnetic-force points and the extent of the scattering of toner is not simply proportional. That is, increase in the number of zero-magnetic-force points by one results in increases in the amount by which toner scatters, by area ratio although it depends on the state of the surrounding magnetic field. Further, the distance between the adjacent two low-magnetic-force points becomes smaller, and therefore, the areas through which the toner can scatter (leak) increases in number.

As described above, it is evident that in a case where a magnetic roller is provided with mutually repelling magnetic poles which are next to each other, increasing the magnetic seal in the number of magnetic poles which face a point between the mutually repelling magnetic poles of the magnetic roller does not improve the magnetic seal in sealing performance, unlike Conventional Technologies 2 and 3. Even in the case of Conventional Technologies 2 and 3, increasing a magnetic seal in the number of magnetic poles improves the magnetic seal in overall sealing performance, although the number of zero-magnetic force points increases. Conversely, in a case where a magnetic roller has mutually repelling magnetic poles which are next to each other, increasing the magnetic seal in the number of magnetic poles greatly reduces the magnetic seal in sealing performance.

Figure 24:
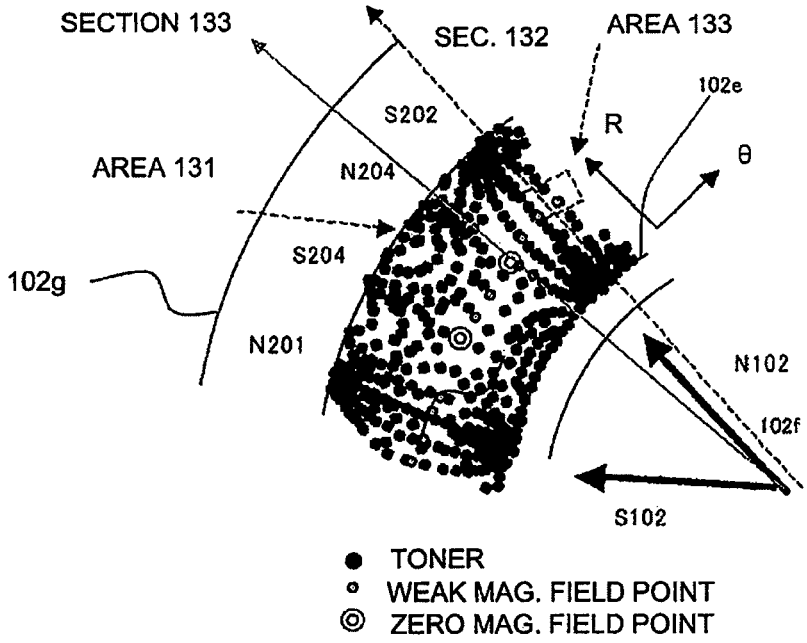
Fig. 24 PRIOR ART
FIG. 24 is a drawing of the magnetic force distribution of the magnetic field of the developing apparatus in accordance with Conventional Technology 3.
Figure 25:
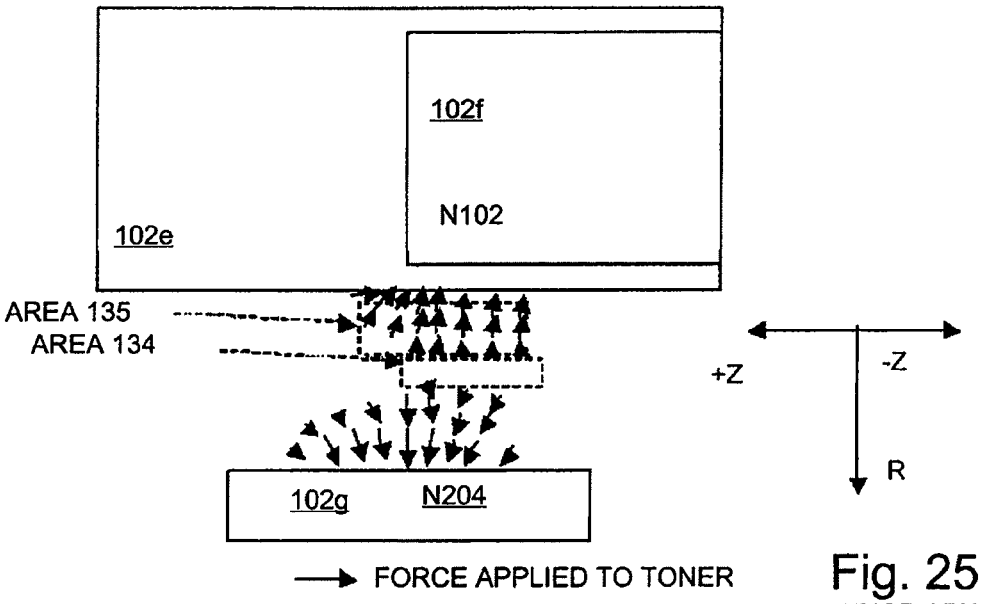
Fig. 25 PRIOR ART
FIG. 25 is a drawing showing the distribution of the magnetic force which acts on the toner in the thrust direction of the development sleeve of the developing apparatus in accordance with Conventional Technology 2.

Next, the reason for the occurrence of the above-described effects will be described. First, the case in which a magnetic roller does not have mutually repelling magnetic poles which are next to each other will be described. This case will be described with reference to FIG. 25, which shows the distribution of the magnetic force which acts on the toner particles in the direction parallel to the thrust direction of the development roller, at a plane (sectional plane 133) which coincides with the zero-magnetic-force points of a developing apparatus based on Conventional Technology 3 (FIG. 24) which is in accordance with the conventional technological thinking. An area 134 (sectional plane 133) is a zero-magnetic-force point. The toner particles on, or in the adjacencies of, the inward surface of the magnetic seal 102*g*, remain magnetically attracted to the magnetic seal 102*g*, whereas the toner particles on, or in the adjacencies of, the peripheral surface of the development sleeve 102*e* remain attracted to the development sleeve 102*e* by the magnetic pole N102 of the magnetic roller 102*f*. The toner particles in, or in the adjacencies of, the area 134, which is a zero-magnetic-force area, remain constrained by the magnetic force from the magnetic seal 102*g* as well as the magnetic force from the magnetic roller 102*f*.

Figure 26:
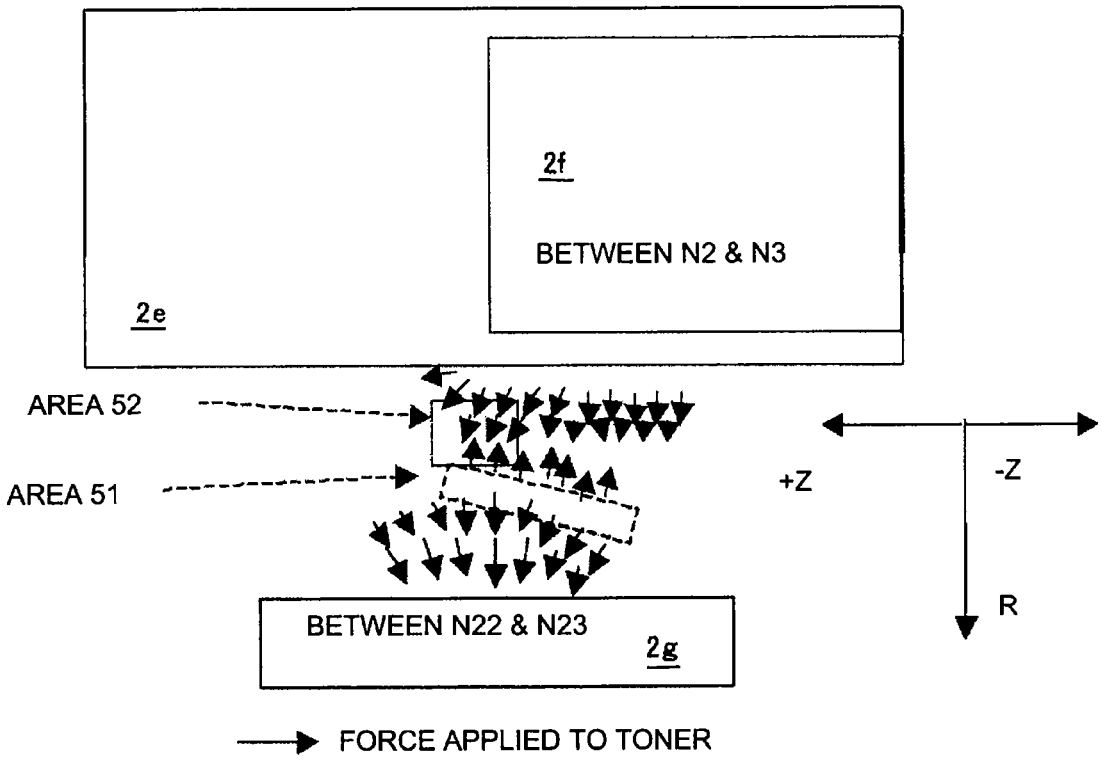
FIG. 26 is a drawing showing the distribution of the magnetic force which acts on the toner in the thrust direction of the development sleeve of the developing apparatus in the first preferred embodiment of the present invention.

Next, a case in which a magnetic roller is provided with mutually repelling magnetic poles which are next to each other will be described referring to FIG. 26 which shows the distribution of the magnetic force which acts on the toner particles in the direction parallel to the thrust direction, at a sectional plane 34 (FIG. 7) which cuts across the area 35 which includes the zero-magnetic-force areas of the magnetic force distribution in the first preferred embodiment. In this case, the toner particles remain attracted by the magnetic force of the magnetic poles N22 and N23 of the magnetic seal 2*g*. In an area 51, the magnetic force from the magnetic roller 2*f* and the magnetic force from the magnetic seal 2*g* repel each other, turning the area 51 into an area with no magnetic field (area with no magnetic force). That is, there is a tone repelling magnetic field is in the area 51; magnetic force works in the direction to repel the toner particles out of area 51. In the adjacencies of the magnetic roller 2*f*, the toner particles remain directed away from the magnetic roller 2*f*, because of the effect from the mutually repelling magnetic forces from the magnetic poles N2 and N3. Therefore, the toner particles collide with each other in the area 52. The combination of these forces works in the direction to move the toner particles outward (+Z direction). Therefore, the toner particles scatter. Thus, in a case, such as this case, where a magnetic roller has mutually repelling magnetic poles which are next to each other, the toner particles in the adjacencies of the zero-magnetic-force area are not likely to be reliably constrained by magnetic force, as well as the toner particles in a developing apparatus in accordance with the conventional technologies, and therefore, the toner is likely to scatter. That is, in a case where a magnetic roller having mutually repelling magnetic poles which are positioned next to each other to prevent toner deterioration is employed as the magnetic roller for a developing apparatus, it is important that the developing apparatus is designed so that the number of the zero-magnetic-force points becomes as small as possible.

Described next will be the method used to calculate the amount of force to which the toner particles were subjected in the simulations used to verify the virtues of the present invention. The amount F of the magnetic force to which toner particles are subjected by a magnetic field B can be expressed by the following equation. It is necessary to take into consideration the direction of the magnetic force of the magnetic field B, which is parallel to the thrust direction of the development sleeve, and the direction of the magnetic force of the magnetic field B, which is perpendicular to the development sleeve.

$$F=(m\cdot\nabla)B$$

$$F=(fx,fy,fz)$$

$$|F|=(fx^2+fy^2+fz^2)^{0.5}$$

m: magnetic dipole moment (proportional to magnetic field)

C: constant $$m=|C|B$$

Substituting |C|B for m in equation F=(m·∇)B, $$F=(|C|B\cdot\nabla)B$$

$$=|C|(B\cdot\nabla)B=-C|\nabla B^2$$

The amount of each of the magnetic forces fx, fy, and fz are:

$$fx=-|C|(B(x,y,z)^2-B(x+\Delta x,y,z)^2/\Delta x$$

$$fy=-|C|(B(x,y,z)^2-B(x,y+\Delta y,z)^2/\Delta y$$

$$fz=-|C|(B(x,y,z)^2-B(x,y,z+\Delta z)^2/\Delta z$$

Thus, the absolute value of B, that is, $|B|(Bx^2+By^2+Bz^2)^{0.5}$ does not change. Unless the absolute value of B changes, the amount of the magnetic force to which the toner particles are subjected does not change. In other words, it shows that there is no magnetic force to which the toner particles are subjected.

That is, in the areas with no magnetic flux, there is no magnetic force to which the toner particles are subjected, and therefore, the toner particles scatter as the development sleeve is rotated at a high speed. Moreover, the amount of the magnetic force to which the toner particles are subjected is square of the strength of the magnetic field. Therefore, the greater the magnetic field in the amount of change, the greater the amount of the magnetic force to which the toner particles are subjected. In other words, the smaller the magnetic field in the amount of change, the smaller the magnetic force to which the toner particles are subjected. For example, the greater the number of the zero-magnetic-force points (areas), the greater the number of the areas in which the magnetic force to which the toner particles are subjected is small.

In FIG. 7 which shows the magnetic force distribution of the developing apparatus in this preferred embodiment, the x and y directions are illustrated as the directions R and θ, respectively. In the case of the developing apparatus in this preferred embodiment, there is no magnetic flux which is parallel to the directions R, θ, and z. That is, the toner particles are likely to scatter, in particular, in the areas in which no toner particle is present.

FIG. 3 is a schematic drawing of the developing apparatus in the first preferred embodiment, and shows the structure of the apparatus in terms of the lengthwise direction of the apparatus (direction parallel to axial line of development roller). The magnetic seal 2*g* is disposed so that it overlaps with the lengthwise end portion (+z direction) of the magnetic roller 2*f*, whereas the magnetic seal 2*f*, that is, the other magnetic seal, is disposed so that it overlaps with the other lengthwise end portion (−z direction).

Naturally, in the case of the magnetic seal 2*g*, the scattering of toner can be prevented as the magnetic force works in the direction −z, whereas in the case of the magnetic seal 2*h*, the scattering of toner can be prevented as the magnetic force works in the direction +z.

The magnetic flux, and the amount of the magnetic force to which the toner particles are subjected, are calculated (simulated) with the use of the following procedure. The size of the magnetic field can be measured by a ready-made Gauss meter (Tesla meter). In the case of the first preferred embodiment, a Gauss meter (Model 640: product of Bell Laboratory Co., Ltd.) was used. A Gauss meter can measure the magnetic flux density in a single direction with its probe. In this case, the magnetic flux densities Bx, By, and Bz in three directions x, y, and z were measured using x, y, z stages, respectively. The strength of the magnetic field B was calculated from the results of the measurements. The magnetic flux density was measured with 0.1 degree intervals in terms of the circumferential direction of the development sleeve, and the distribution of the magnetic force in the magnetic field was obtained from the results of the measurements. Then, the amount of the magnetic force to which the toner particles were subjected was calculated in consideration of the magnetic properties of the toner, the size of the gap between the development sleeve and magnetic seal, and the like factors. In the simulation, the amounts Δx, Δy, and Δz of changes were set to roughly 100μ. The smaller the gap, the more precise, but the more time it takes for the calculation. From the standpoint of precision, the amount of change is desired to be no less than 1/10, and no more than 1/5, of the gap between the development sleeve and magnetic seal. The calculation was made involving only the magnetic roller, magnetic seal, and regulation blade, which are magnetically affected.

It is desirable that the magnetic seals 2*g* and 2*h* are made of iron, nickel, cobalt, or one of other highly magnetic substances. The thickness of the magnetic seals is desired to be in a range of 1 mm-3 mm, although it depends of the necessary amount of magnetic force and the necessary thickness for the magnetic seals. The desired width of the magnetic seals depends on the magnetic force ripple at the lengthwise ends of the magnetic rollers 2*f*. In a case where the ripple is roughly 130 mt/4 mm, the width of the magnetic seals is desired to be roughly 8 mm, that is, twice the amount of the ripple. The maximum energy product (residual magnetic flux density, coercive force) of the material for the magnetic seal is desired to be no more than 0.7 $J/m^2$. Regarding the magnetic flux density, the material for the magnetic seals has only to be such a rubber magnet, a neodymium magnet, or plastic magnet, the magnetic density of which is a range of 40-200 mT (Tesla). Selecting a material, the magnetic flux density of which reaches the targeted saturation magnetic flux density, as the material for the magnetic seals, makes it easier to provide magnetic seals which are stable in magnetic flux density distribution, although it depends on the properties of the chosen magnetic material. In this preferred embodiment, the gap between the development sleeve and magnetic seal was 0.75 mm. However, the gap does not need to be limited to 0.75 mm. However, for the purpose of preventing the problem that as the development sleeve is rotated, heat is generated by the friction between the toner particles and magnetic seal, the gap is desired to be no less than 0.3 mm, and no more than 1.25 mm, beyond which the magnetic force for constraining the toner particles is significantly weaker.

Figure 13:
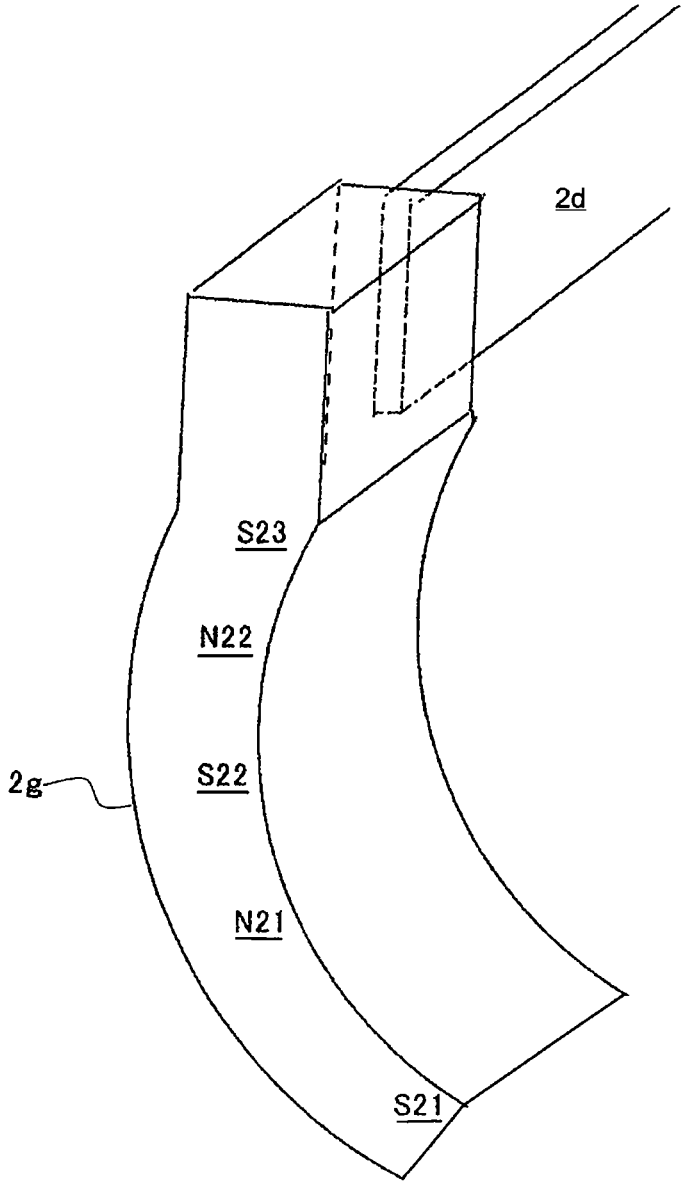
FIG. 13 is a schematic drawing showing the positional relationship between the magnetic seal and regulating blade in the first preferred embodiment of the present invention.

For the simulation, the gap between the magnetic regulation blade 2*d* and development sleeve 2*e* was set to 0.2 mm. The regulation blade 2*d* is a piece of flat plate, and is 0.6 mm in thickness. It was held so that its widthwise direction coincides with the axial line of the development sleeve 2*e*. However, the positioning of the regulation blade does not need to be limited to the above-described one. For the purpose of preventing the problem that as the development sleeve 2*e* is rotated, heat is generated by the friction between the toner particles and regulation blade 2*d*, the gap between the regulation blade 2*d* and development sleeve 2*e* is desired to be no less than 0.10 mm. Further, for the purpose of preventing the cresting of the toner layer, the gap is desired to be no more than 0.35 mm. FIG. 13 shows the positional relationship between the magnetic seal 2*g* and regulation blade 2*d*. The lengthwise ends of the regulation blade 2*d* are kept in contact with the corresponding magnetic seal (2*g* or 2*f*), preventing thereby the toner particles from scattering.

In the case of the first preferred embodiment, the experiments (simulations) were carried out using a magnetic single-component toner, that is, a toner which contains a magnetic substance in its particles. However, the present invention is also compatible with a magnetic two-component developer, that is, a toner made up of nonmagnetic toner particles and magnetic carrier particles.

Further, the toner t is a negative toner, and its weight average particle diameter is in a range of 5.0-10.0 μm. Its resinous material is a styrene-acrylic resin, or polyester resin, and contains magnetic substance by 50-100 parts by weight. The specific permeability of the toner t is in a range of 1.5-2.0. The toner used for the experiments was 1.65 in specific permeability. The toner t contained $SiO_2$, as an external additive, by 0.2-3.0% (weight percent).

The following became evident from the above-described experiments and calculations. In the case of the magnetic roller having mutually repelling magnetic poles which are next to each other, it is desired that the magnetic poles of the magnetic seal, which oppose the mutually repelling magnetic poles of the magnetic roller are opposite in polarity from the mutually repelling magnetic poles of the magnetic roller, being different from the setup based on the conventional technical thinking. Further, it was possible to confirm, from the above-described experiments (simulations), that the amount by which toner scatters can be reduced, while preventing the toner deterioration, by placing an additional magnetic pole, which is the same in polarity as the mutually repelling magnetic poles of the magnetic roller, between the mutually repelling magnetic poles of the magnetic seal, which oppose the mutually repelling magnetic poles of the magnetic roller.

Incidentally, the above-described development condition is nothing but an example. That is, the development condition is desired to be optimized according to the specifications and requirements of the image forming apparatus.

Embodiment 2

Figure 14:
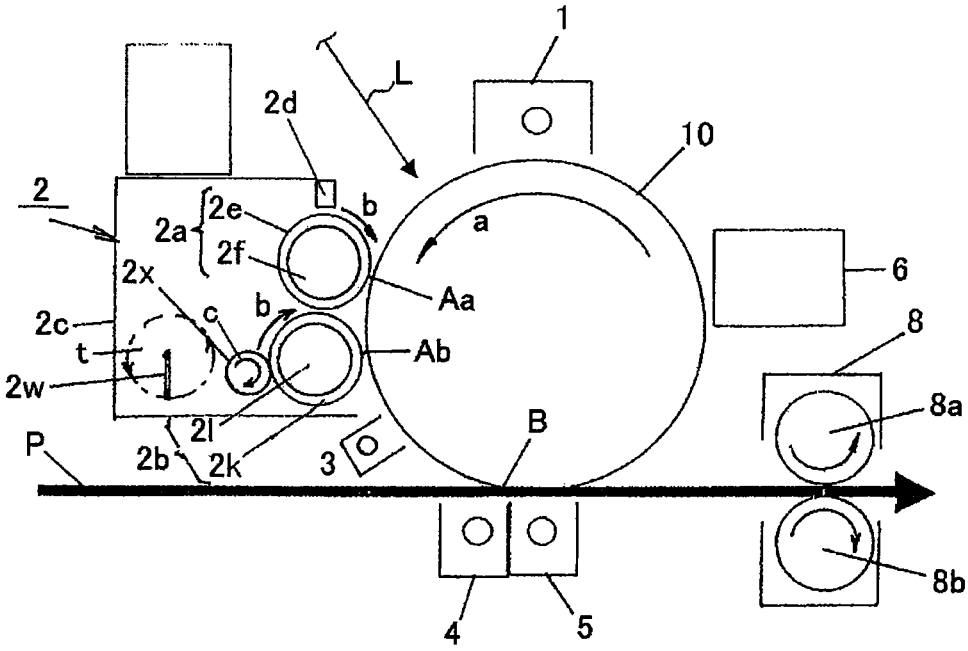
FIG. 14 is a schematic sectional view of the image forming apparatus in the second preferred embodiment of the present invention, and shows the general structure of the image forming apparatus and the general structure of the developing apparatus of the image forming apparatus.

FIG. 14 is a schematic sectional view of the image forming apparatus equipped with the developing apparatus 2 in the second preferred embodiment of the present invention, and shows the general structure of the image forming apparatus and the general structure of the developing apparatus of the image forming apparatus. The structural components and structural portions of the image forming apparatus in this preferred embodiment, which are the same as the counterparts of the image forming apparatus in the first preferred embodiment (FIG. 2) will be given the same referential codes as those given to the counterparts, and will not be described here to avoid repetition of the same description.

The developing apparatus 2 in this embodiment has two (first and second) development rollers 2*a* and 2*b*, which are disposed so that their peripheral surfaces are virtually in contact with the peripheral surface of the photosensitive member 10. The first development roller 2*a* is made up of a first development sleeve 2*e*, which is the first developer bearing member, and a first magnetic roller 2*f*, which is the first magnetic member. The magnetic roller 2*f* is within the development sleeve 2*e*. The second development roller 2*b* is made up of a second development sleeve 2*k*, which is the second developer bearing member, and a second magnetic roller 21, which is the second magnetic member. The magnetic roller 21 is within the development sleeve 2*k*. The second development sleeve 2*k* is on the downstream side of the first development sleeve 2*e* in terms of the rotational direction of the photosensitive member 10, and is parallel to the first development sleeve 2*e*, with the presence of a preset amount of gap between the peripheral surface of the development sleeve 2*e* and the peripheral surface of the development sleeve 2*k*.

Hereafter, the first development roller 2*a* will be referred to as the upstream development roller, and the first development sleeve 2*e* will be referred to as the upstream development sleeve. The first magnetic roller 2*f* will be referred to as the upstream magnetic roller. Further, the second development roller 2*b* will be referred to as the downstream development roller, and the second development sleeve 2*k* will be referred to as the downstream development sleeve. Further, the second magnetic roller 21 will be referred to as the downstream magnetic roller.

The area in which the distance between the peripheral surface of the upstream development sleeve 2*e* and the peripheral surface of the photosensitive member 10 is smallest is the development area Aa, and the area in which the distance between the peripheral surface of the downstream development sleeve 2*k* and the peripheral surface of the photosensitive member 10 is smallest is the development area Ab. The upstream development sleeve 2*e* and downstream development sleeve 2*k* are rotationally driven by a driving apparatus (unshown) in the clockwise direction indicated by a pair of arrow marks at a preset peripheral velocity. That is, the upstream and downstream development sleeves 2*e* and 2*k*, respectively, are rotationally driven in such a direction that their peripheral surfaces move in the same direction as the peripheral surface of the photosensitive member 10 in the development area Aa and Ab, respectively.

The toner t (magnetic single-component developer) in the developer container 2*c* is conveyed toward the toner supply roller 2*x* by the rotation of a toner stirring member 2*w* while being stirred by the stirring member 2*w*. The toner supply roller 2*x* is rotationally driven in the clockwise direction indicated by an arrow mark c while remaining in contact with the downstream development sleeve 2*k*. That is, the toner supply roller 2*x* supplies the downstream development sleeve 2*k* with the toner t by being driven so that the direction in which its peripheral surface moves in the area of contact between it and downstream development sleeve 2*k*, becomes opposite to the direction in which the peripheral surface of the downstream development sleeve 2*k* moves in the area of contact between it and downstream development sleeve 2*k*. The supplied toner is attracted to the peripheral surface of the downstream development sleeve 2*k* by the magnetic force of the magnetic roller 21, and magnetically held to the peripheral surface of the downstream development sleeve 2*k* by the magnetic force. Then, as the downstream development sleeve 2*k* is rotated, the toner on the peripheral surface of the downstream development sleeve 2*k* is conveyed by the rotation of the downstream development sleeve 2*k*, toward where the distance between the peripheral surface of the downstream development sleeve 2*k* and the peripheral surface of the upstream development sleeve 2*e* is smallest. While the toner on the peripheral surface of the downstream development sleeve 2*k* is moved through the gap between the downstream development sleeve 2*k* and upstream development sleeve 2*e*, the toner layer on the peripheral surface of the downstream development sleeve 2*k* is regulated in thickness by the upstream development sleeve 2*e*, the rotational direction of which in the gap between the two development sleeves 2*k* and 2*e* is opposite to the direction of the rotation of the downstream development sleeve 2*e* in the gap. As a result, a toner layer with a preset thickness is formed on the peripheral surface of the development sleeve 2*k*. Then, the toner layer with the preset thickness is conveyed to the downstream development area Ab by the subsequent rotation of the development sleeve 2*k*. Meanwhile the toner particles which did not move through the gap between the downstream development sleeve 2*k* and upstream development sleeve 2*e* adhere to the peripheral surface of the upstream sleeve 2*e*, the moving direction of which in the gap between the upstream and downstream development sleeve 2*e* and 2*k* is opposite to the moving direction of the downstream development sleeve 2*e* in the gap. That is, the toner is attracted to the peripheral surface of the upstream development sleeve 2*e* by the magnetic force of the upstream magnetic roller 2*f*, and magnetically held to the peripheral surface of the upstream development sleeve 2*e* by the magnetic force. Then, as the toner on the upstream development sleeve 2*e* is conveyed further by the rotation of the upstream development sleeve 2*e*, the toner layer on the peripheral surface of the upstream development sleeve 2*e* is regulated in thickness by a toner layer thickness regulating blade 2*d*, which is disposed so that there is a preset amount of gap between its regulating edge and the peripheral surface of the development sleeve 2*e*. As a result, a thin layer of toner is formed on the peripheral surface of the development sleeve 2*e*. Then, the thin layer of toner is conveyed to the first development area Aa (upstream development area) by the subsequent rotation of the upstream development sleeve 2*e*.

During a development operation, a preset development bias is applied to the upstream and downstream sleeve 2*e* and 2*k* from their electric power sources (unshown), respectively. Thus, the peripheral surface of the photosensitive member 10 is supplied with toner (first development operation) in the first development area Aa. Then, it is supplied with toner (second development operation) in the second development area Ab (downstream development area), whereby the electrostatic latent image on the peripheral surface of the photosensitive member 10 is developed into a visible image, that is, an image formed of toner.

Incidentally, the developing apparatus may be structured so that it does not have the toner supply roller 2*x*.

Figure 15:
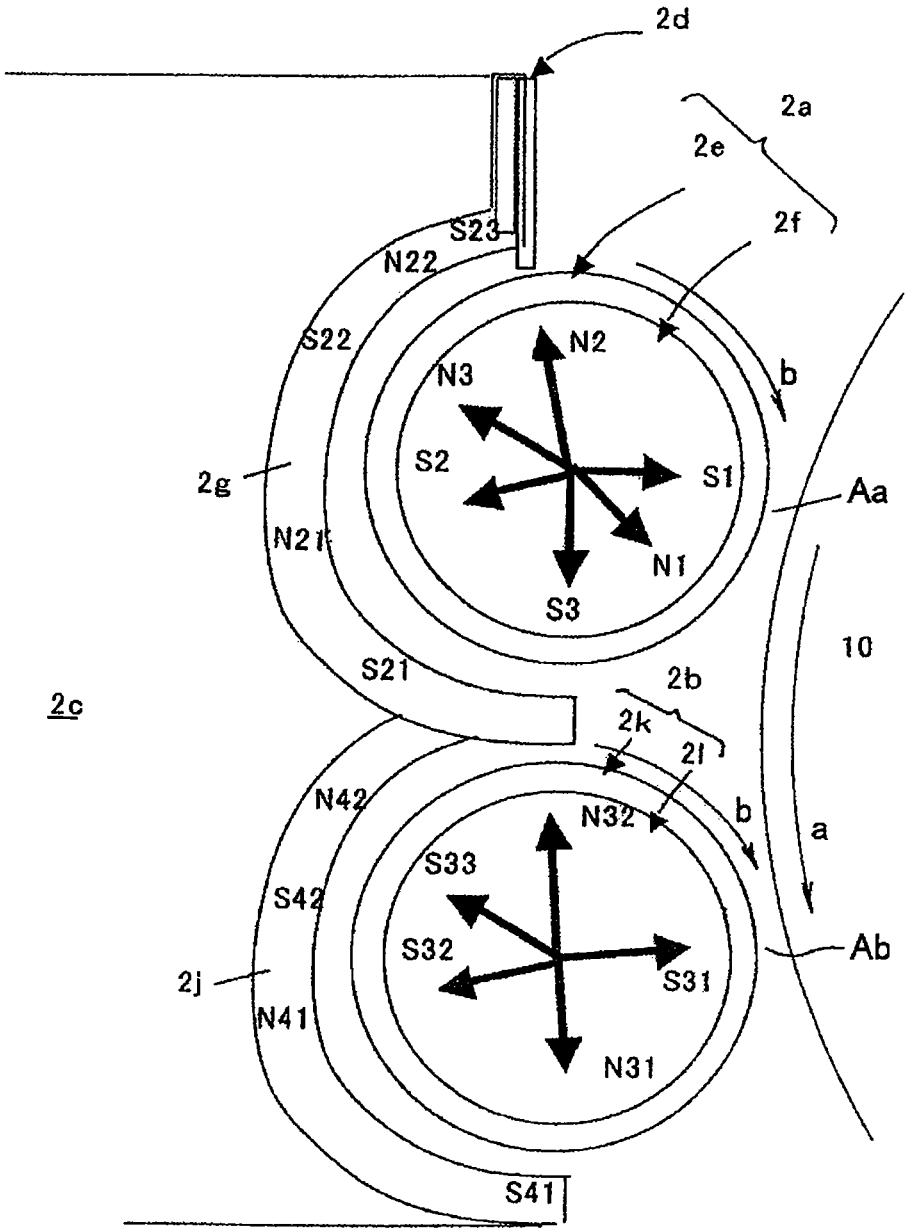
FIG. 15 is a schematic sectional view of the essential portions of the developing apparatus in the second preferred embodiment of the present invention.
Figure 16:
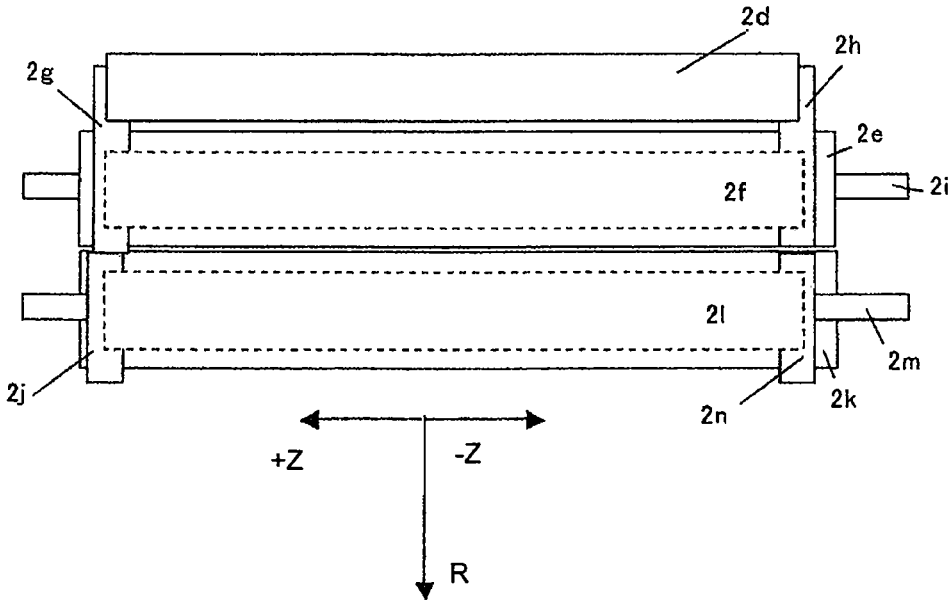
FIG. 16 is a drawing showing the positioning of the developing apparatus components, in the second preferred embodiment of the present invention, in terms of the thrust direction of the development sleeve.

FIG. 15 is an enlarged schematic cross-sectional view of the essential portions of the above-described developing apparatus 2. FIG. 16 is a schematic view of the developing apparatus 2, and shows the positioning of the components of the developing apparatus 2 in terms of the thrust direction of the development sleeves 2*e* and 2*k*.

The upstream magnetic rollers 2*f* is provided with magnetic poles S1, N1, N2, S3, S2, N3, and N2, which are in the listed order. The magnetic poles N3 and N2 are the mutually repelling magnetic poles, which are next to each other. As for the downstream magnetic roller 21, it is provided with magnetic poles S31, N31, S32, S33, and N32, which are in the listed order in terms of the circumferential (rotational) direction of the downstream magnetic roller 21. The magnetic poles S32 and S33 are the mutually repelling magnetic poles which are next to each other.

In order to prevent the toner from leaking from the developing apparatus 2 at the lengthwise end portions of the upstream development sleeve 2*e*, the lengthwise end portions of the developing apparatus 2 are provided with a pair of sealing members 2*g* and 2*h*, one for one. The sealing members 2*g* and 2*h* are magnetic seals and are permanent magnets. Each of the sealing members 2*g* and 2*h* prevents the toner from scattering through the gap between the magnetic seal 2*g* (2*h*) and the magnetic roller 2*f*, by its magnetic force. The sealing members 2*g* and 2*h* (which are first seals, and will be referred to as upstream magnetic seals) are solidly attached to the developer container 2*c*, with the presence of a preset distance between the sealing member 2*g* (2*h*) and the peripheral surface of the upstream development sleeve 2*e*. They are on the opposite side of the development sleeve 2*e* from the photosensitive member 10. In this embodiment, the positioning of the upstream magnetic seals 2*g* and 2*h* is such that in terms of the direction perpendicular to the lengthwise direction of the upstream magnetic roller 2*f*, the upstream magnetic seals 2*g* and 2*h* partially overlap with the lengthwise ends of the magnetic rollers 2*f*. Designated by a referential code 2*i* is the axis of the magnetic roller 2*f* (rotational axis of upstream magnetic roller 2*f*).

Further, the developing apparatus 2 is also provided with a pair of sealing members 2*j* and 2*n*, which are at the lengthwise ends, one for one, of the downstream development sleeve 2*k* to prevent the toner from leaking. The sealing members 2*k* and 2*n* also are permanent magnets (magnetic seals), and their magnetic force prevents the toner from scattering through the gap between them and the downstream magnetic roller 21. The sealing members 2*k* and 2*n* (second magnetic seals, which hereafter will be referred to as downstream magnetic seals) are on the developer container, and are not movable. They are on the opposite side of the development roller 2*b* from the photosensitive member 10, with the presence of a preset distance between them and the development roller 2*b*. In this embodiment, their positioning in terms of the lengthwise direction of the downstream magnetic roller 21 is such that in terms of the direction parallel to the lengthwise direction of the downstream magnetic roller 21, the downstream magnetic seals 2*k* and 2*n* partially overlap with the lengthwise ends of the magnetic roller 21, one for one. Designated by a referential code 2*m* is the downstream magnetic roller shaft (rotational axis of downstream magnetic roller 21).

The upstream magnetic seal 2*g*, that is, one of the magnetic seals for the upstream magnetic roller 21, and the upstream magnetic seal 2*h*, that is, the other magnetic seal for the upstream magnetic roller 21, are the same in magnetic pole placement pattern. The downstream magnetic seal 2*j*, that is, one of the magnetic seals for the downstream magnetic roller 21, and the downstream magnetic seal 2*n*, are the same in magnetic pole placement pattern. Therefore, the upstream magnetic seal 2*g*, that is, one of the upstream magnetic seals, and the downstream magnetic seal 2*j*, that is, one of the downstream magnetic seals, will be described regarding their magnetic pole placement patterns, which characterize this preferred embodiment of the present invention, with reference to FIG. 15.

The upstream magnetic seal 2*g* (2*h*) has magnetic poles S22 and S23, which oppose the aforementioned mutually repelling magnetic poles N3 and N2 of the upstream magnetic roller 2*f*, and are different in magnetic polarity from the mutually repelling magnetic poles N3 and N2. The upstream magnetic seal 2*g* has also a magnetic pole N22, which opposes a point between the mutually repelling magnetic poles N3 and N2 and is the same in polarity as the magnetic poles N3 and N2. This structural arrangement is the same as the structural arrangement of the developing apparatus in the first preferred embodiment.

The magnetic pole placement of the downstream magnetic seal 2*j* (2*n*) is the same as that of the upstream magnetic seal 2*g* (2*h*). That is, the downstream magnetic seal 2*k* (2*l*) has magnetic poles N41 and N42, which oppose the aforementioned mutually repelling magnetic poles S32 and S33 of the downstream magnetic roller 21, and are different in magnetic polarity from the mutually repelling magnetic poles S32 and S33. The downstream magnetic seal 2*j* has a magnetic pole S42, which opposes a point between the mutually repelling magnetic poles S32 and S33 and is the same in polarity as the magnetic poles S32 and S33. More concretely, the downstream magnetic roller 21 has magnetic poles S31, N31, S32, S33, and N32, which are in the listed order in terms of the circumferential (rotational) direction of the downstream magnetic roller 2. The downstream magnetic seal 2*j* has magnetic poles S41, N41, S42, and N42, which are in the listed order. Further, the downstream magnetic seal 2*j* has a magnetic pole S42, which is between the magnetic poles N41 and N42 (which are opposite in polarity from the mutually repelling magnetic poles S32 and S33), and opposes a point between the mutually repelling magnetic poles S32 and S33. The magnetic pole S42 of the magnetic seal 2*j* is the same in polarity as the mutually repelling magnetic poles S32 and S33.

Next, the toner flow in the developing apparatus 2 in this (second) preferred embodiment will be described. In the developer container 2*c*, the toner particles in the adjacencies of the downstream magnetic sleeve 2*k* are adhered to the magnetic sleeve 2*k* by the magnetic pole S33 of the magnetic roller 21, and are separated into a group which is conveyed toward the magnetic pole N32 of the downstream magnetic roller 21 by the rotation of the downstream development sleeve 2*k*, and another group which is conveyed toward the magnetic pole S2 of the upstream magnetic roller 2*f* by the rotation of the upstream development sleeve 2*e*. The toner particles conveyed toward the magnetic pole S2 are conveyed through the area between the magnetic poles N3 and N2. While the toner particles are conveyed through the area between the magnetic poles N3 and N2, they are temporarily peeled away from the peripheral surface of the upstream development sleeve 2*e* by the repelling of the magnetic poles N3 and N2 against each other. But, they are conveyed by their inertia to the rear side of the regulation blade 2*d*, and are pulled back (adhered to) the peripheral surface of the upstream development sleeve 2*e* by the magnetic force of the magnetic pole N2. Thus, a toner layer, which has a preset amount of toner per unit area, is formed on the peripheral surface of the upstream development sleeve 2*e* by the magnetic constraining force of the magnetic pole N2 and the regulation blade 2*d*. Then, the coated toner particles are used for developing the electrostatic latent image on the photosensitive member 10, in the development area Aa, which corresponds in position to the magnetic pole S1 of the magnetic roller 2*f*. The residual toner particles, that is, the toner particles which were not used for the development, are conveyed further while remaining attached to the peripheral surface of the upstream development sleeve 2*e* by the magnetic poles N1 and S3. Then, as they are conveyed through the area between the magnetic poles S3 and S2, they are peeled away by the repelling of the magnetic poles S3 and S2 against each other, and mix with the toner particles in the developer container 2*c*.

Meanwhile, the other group of toner particles, that is, the group of toner particles kept on the peripheral surface of the downstream development sleeve 2*k* by the magnetic pole S33 of the downstream magnetic roller 21 is formed into a toner layer, which has a preset amount of toner per unit area, on the peripheral surface of the downstream development sleeve 2*k* by the magnetic constraining force from the magnetic poles N32 and S3. Then, they are used for developing the electrostatic latent image on the photosensitive member 10, in the second development area Ab, which corresponds in position to the magnetic force S31 of the magnetic roller 21. The toner particles remaining on the peripheral surface of the development sleeve 2*k* after the development are taken back into the developer container 2*c* by the rotation of the development sleeve 2*k* while remaining kept on the peripheral surface of the development sleeve 2*k* by the magnetic pole N31, Then, they are conveyed further past the area which corresponds in position to the magnetic pole S32. Then, as they are conveyed through the area between the magnetic poles S32 and S33, they are repelled away from the peripheral surface of the development sleeve 2*k* by the mutually repelling forces from the mutually repelling magnetic poles S32 and S33, and mix into the toner particles in the developer container 2*c*.

Referring to FIG. 16, in terms of the thrust directions +z and −z of the development rollers 2*a* and 2*b* of the developing apparatus 2, the developing apparatus 2 is provided with a total of four magnetic seals, that is, the magnetic seals 2*g* and, 2*h* which are in the adjacencies of the lengthwise ends of the magnetic roller 2*f*, one for one, and the magnetic seals 2*j* and 2*n* which are in the adjacencies of the lengthwise ends of the magnetic roller 21. The upstream magnetic seals 2*g* and 2*h* are in contact with the regulation blade 2*d*. The magnetic seals 2*g* and 2*j* are the same in width, and the magnetic seals 2*h* and 2*n* are the same in width. Further, in terms of the thrust direction of the upstream and downstream magnetic roller 2*f* and 21, the upstream and downstream 2*f* and 21 are the same in position.

Given in Table 2 are the results of the experiment in which the developing apparatus in the second preferred embodiment was tested.

TABLE 2

| | Mag. Roll Pattern | Mag. Seal Pattern | Mag. flux Density in R | Evaluation (Toner scatter at k sheets |
|---|---|---|---|---|
| | 2b | 2j | 80 | |
| Emb. 2 | N32, S33, S34, N31 | N42, S42, N41, S41 | 80 | 330 |
| Emb. 2-2 | N32, S33, S34, N31 | N42, S42, N41, S34, N43, S41 | 80 | 500 |

First, the differences of the developing apparatus 2 in this preferred embodiment from the developing apparatus 2 in the first preferred embodiment will be described. The gap between the upstream development sleeve 2*e* and downstream development sleeve 2*k* is roughly 250 μm. The peripheral velocity of the downstream development sleeve 2*k* is roughly 500 mm/s. The gap between the downstream development sleeve 2*k* and downstream development seal 2*j* is 0.75 mm, which is the same as the gap between the upstream development sleeve 2*e* and upstream magnetic seal 2*g*.

The magnetic force of the downstream development roller 2*b* and the magnetic force of the downstream magnetic seal 2*j* are 80 mT, and are stable. The magnetic force of the upstream development roller 2*a* and the magnetic force of the upstream magnetic seal 2*g* are also 80 mT, and are stable.

In the case of the developing apparatus 2 in the second preferred embodiment, the toner began to scatter as the print count reached 330,000, which is about the same as the approximate print count at which the developing apparatus 2 in the first preferred embodiment began to scatter toner, even though the developing apparatus 2 in the first preferred embodiment had only one development roller 2*a*, whereas the developing apparatus in this preferred embodiment had two development rollers, that is, upstream and downstream development rollers 2*a* and 2*b*. This means that even if a developing apparatus is increased in the number of development rollers, the amount by which toner is scattered remains the same as long as the development rollers and magnetic seals are kept the same in the positioning of their magnetic poles.

Figure 17:
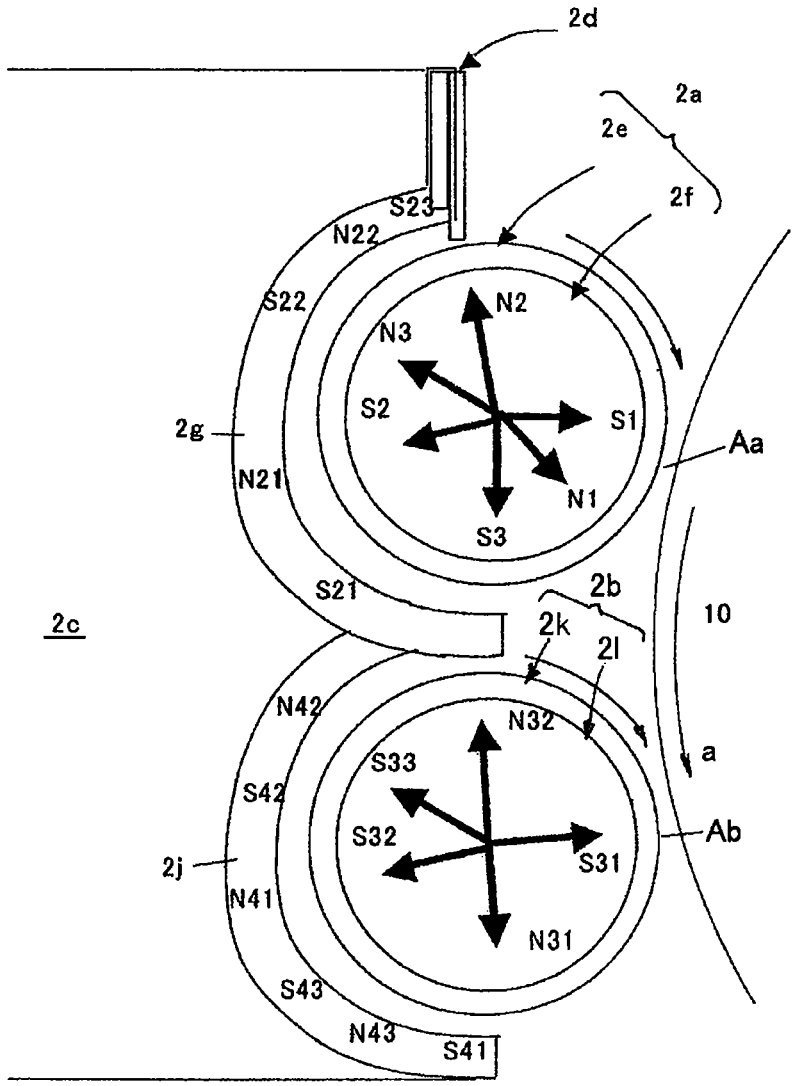
FIG. 17 is a schematic sectional view of the essential portion of the developing apparatus in the first modified version of the developing apparatus in the second preferred embodiment of the present invention.

Next, the developing apparatus 2 in the first modified version (2-2) of the second preferred embodiment will be described. FIG. 17 is a sectional view of the developing apparatus 2 in this modified version of the second preferred embodiment. The magnetic seals of this developing apparatus 2 have a large number of magnetic poles, but, none of them are positioned to repel each other. In the case of this developing apparatus 2, the downstream magnetic seal 2*j* has magnetic poles N43 and S43 which were placed between the magnetic pole S41 and N41 so that the distance between the adjacent two poles became equal, in order to increase the toner constraining magnetic force generated between the magnetic seal and magnetic roller.

Tests were carried out to verify how effective this magnetic pole placement was. The results of the tests are shown in the modified version row of Table 2. In the experiments, this magnetic pole placement prevented the scattering of the toner until 500,000 prints were made. In other words, this magnetic pole placement was 1.5 times more effective than that in the original version of the second preferred embodiment. As is evident from the results of the above-described tests, even in the case of a developing apparatus having two development rollers 2*a* and 2*b*, the magnetic pole of the magnetic seal, which oppose the mutually repelling adjacent magnetic poles of the magnetic roller, is desired to be opposite in polarity from the mutually repelling magnetic poles of the magnetic roller, unlike those in accordance with the conventional technical thinking. Further, it was possible to confirm that the amount by which toner is scattered can be reduced, while preventing toner deterioration, by placing another magnetic pole, which is the same in polarity to the mutually repelling magnetic poles of the magnetic roller, between the magnetic poles of the magnetic seal, which are opposite in polarity from the mutually repelling magnetic poles of the magnetic roller.

Incidentally, the development condition under which the above-described test was carried out was nothing but an example. In other words, the development condition is desired to be optimized according to the specifications of an image forming apparatus, and the environment in which the image forming apparatus is used.

Embodiment 3

Figure 18:
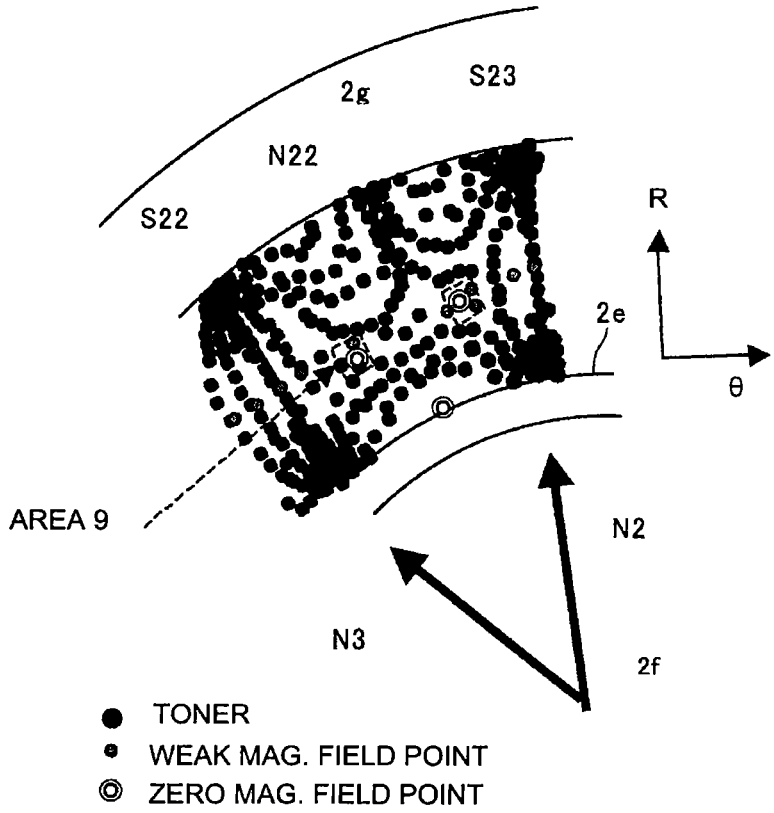
FIG. 18 is a drawing of the magnetic force distribution of the magnetic field of the developing apparatus in the third preferred embodiment of the present invention.

FIG. 18 is a drawing of the magnetic force distribution of the magnetic field of the developing apparatus in the third preferred embodiment of the present invention. In the case of the developing apparatus in this (third) preferred embodiment, the magnetic pole N22 of the magnetic seal 2*g* is greater in magnetic flux density than the adjacent magnetic poles S22 and S23. More concretely, on the portion of the surface of the magnetic seal 2*g*, which faces the development sleeve 2*e*, the magnetic flux density of the magnetic pole N22 in terms of the direction toward the center of the development sleeve is greater than those of the magnetic poles S22 and S23. It is evident from Table 2 that the magnetic poles S22 and S23, which are adjacent to the magnetic pole N22, are greater in the magnetic flux density than the counterparts in the first preferred embodiment, and an area 9 which is zero in the amount of magnetic force, is smaller in size than the counterpart in the first preferred embodiment. As described previously, the greater a developing apparatus in the number the areas with no magnetic force, the worse the developing apparatus in terms of the scattering of toner. Conversely, the smaller a developing apparatus in the number the areas with no magnetic force, the better the developing apparatus in terms of the scattering of toner. The test results of the developing apparatus in the third preferred embodiment are in the third preferred embodiment row of Table 3.

TABLE 3

| | S22 | N22 | S23 | Evaluation (Toner Scattering at k sheets |
|---|---|---|---|---|
| Emb. 1 | 80 | 80 | 80 | 330 |
| Emb. 3 | 80 | 120 | 80 | 500 |
| Emb. 3-2 | 80 | 40 | 80 | 130 |
| Emb. 3-3 | 120 | 120 | 120 | 200 |
| Emb. 3-4 | 40 | 40 | 40 | 75 |

Magnetic flux densities in R direction

The test conditions are the same as those used to test the developing apparatus in the first preferred embodiment, and therefore, will not be described here. Compared to the developing apparatus in the first preferred embodiment, in the case of the developing apparatus in this (third) preferred embodiment, the magnetic flux density of the magnetic pole N22 of the magnetic seal 2*g* is roughly 1.5 times that of the adjacent magnetic poles S22 and S23. It became evident from the results of the test that this preferred embodiment is 1.5 times more effective than the first preferred embodiment, in which the magnetic pole N22 of the magnetic seal 2*g* is the same in magnetic flux density as the adjacent magnetic poles S22 and S23.

Figure 19:
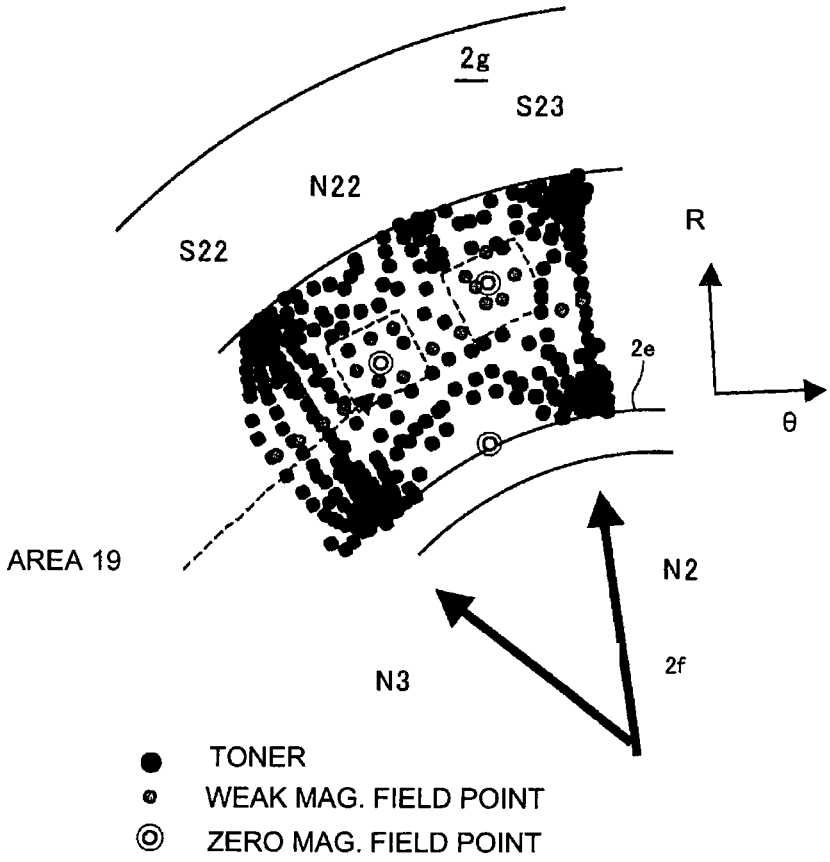
FIG. 19 is a schematic drawing of the magnetic force distribution of the magnetic field of the first modified version of the developing apparatus in the third preferred embodiment of the present invention.
Figure 20:
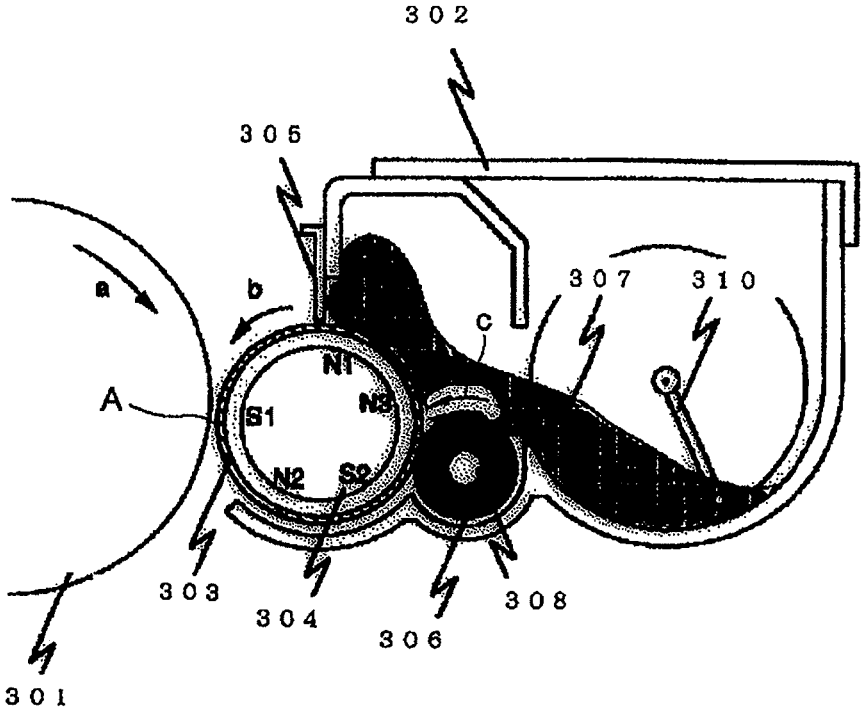
Fig. 20 PRIOR ART
FIG. 20 is a schematic sectional view of a typical developing apparatus in accordance with Conventional Technology 1.
Figure 21:
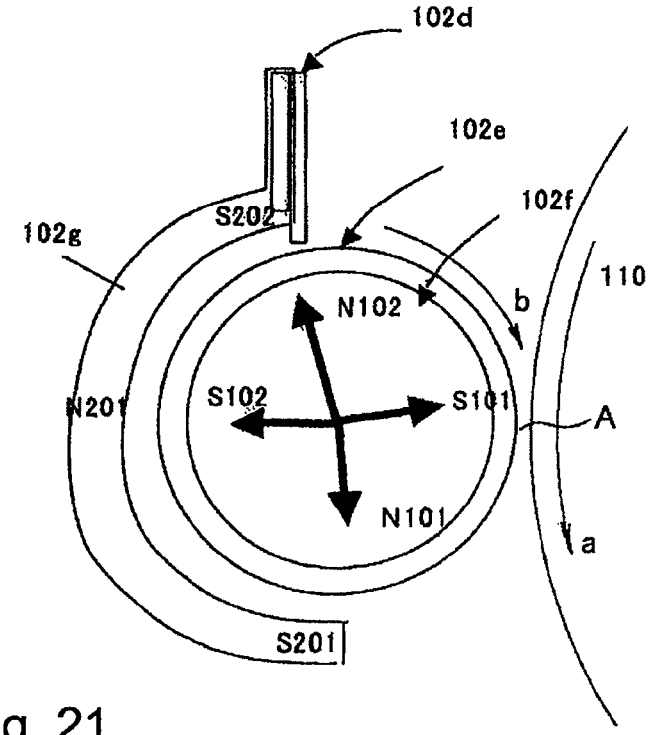
Fig. 21 PRIOR ART
FIG. 21 is a schematic sectional view of the one of the lengthwise end portions of the developing apparatus in accordance with Conventional Technology 2.
Figure 22:
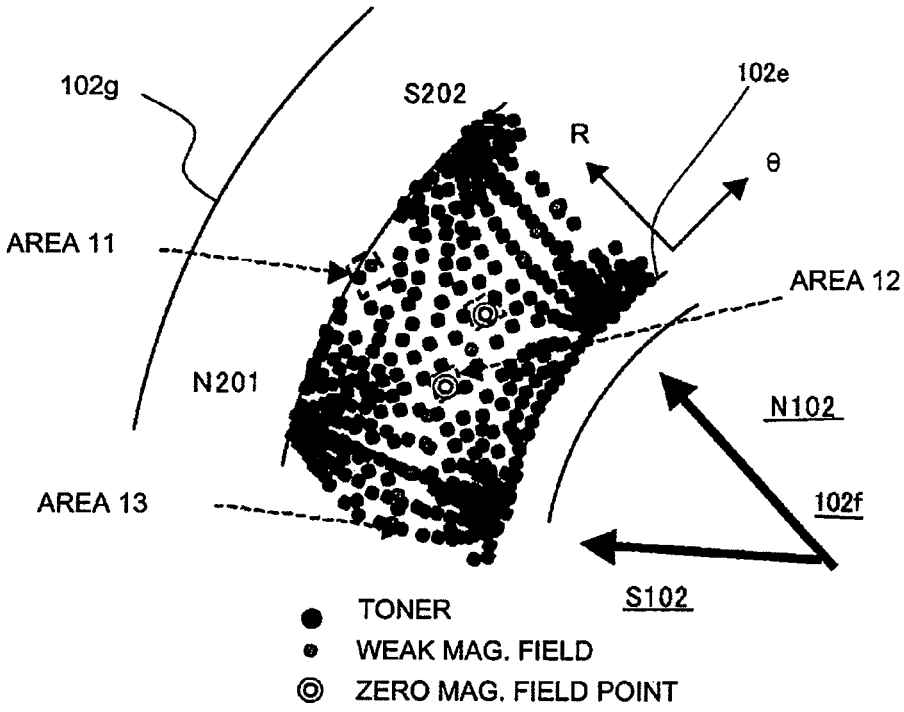
Fig. 22 PRIOR ART
FIG. 22 is a drawing of the magnetic force distribution of the magnetic field of the developing apparatus in accordance with Conventional Technology 2.
Figure 23:
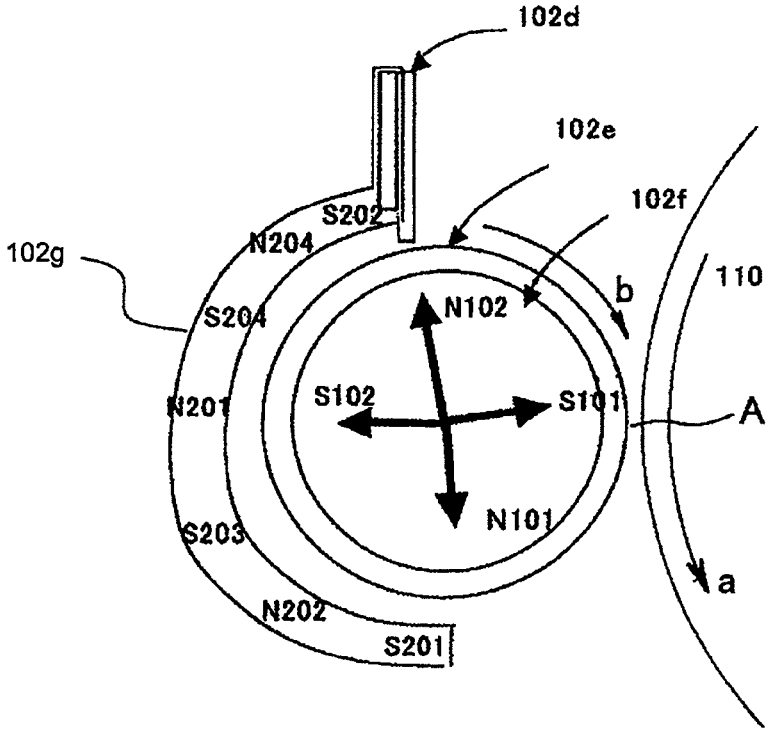
Fig. 23 PRIOR ART
FIG. 23 is a schematic sectional view of the developing apparatus in accordance with Conventional Technology 3.

Shown in FIG. 19 is an example of a developing apparatus in which the magnetic pole N22 is smaller in magnetic force than the adjacent magnetic poles S22 and S23. In this case, the number of areas in which the magnetic force is weak is substantially greater than in the case of the developing apparatus in the first preferred embodiment. The reason therefor is that the reduction in the magnetic force of the magnetic pole N22 reduced in size the magnetic field between the magnetic seal 2*g* and magnetic roller 2*f*. That is, the magnetic pole N22 is united with the magnetic poles S22 and S23. Therefore, as the magnetic pole N22 is reduced in magnetic force, the area (magnetic field) which bridges between the magnetic poles S22 and S23 becomes weak in magnetic force. Further, in terms of unit of magnetization, the amount of the magnetic force to which each toner particle is subjected is inversely proportional to the square of the distance from the toner particle to the source of the magnetic force. That is, as the distance from a source of magnetism increases, the number of the areas with weak magnetic force drastically increases. Therefore, reducing the magnetic pole N22 in magnetic force increases the number of the areas which are low in magnetic force, by the amount close to the square of the distance from the magnetic pole N22, and therefore, makes it easier for toner particles to scatter (leak).

The test results of the developing apparatus in FIG. 19 are in the Embodiment 3-2 row of Table 3. In this case, the magnetic force of the magnetic pole N22 was roughly ½ of the magnetic force of the adjacent magnetic poles S22 and S23 in the first preferred embodiment. The test results show that it was only 40% of the first preferred embodiment which was the same in magnetic force in this embodiment.

As described above, increasing the magnetic pole N22 in magnetic force is effective to prevent toner particles from scattering. Next, what occurs as the adjacent magnetic poles S22 and S23 also are increased in magnetic force will be described with reference to the second modified version of the third preferred embodiment. Although not illustrated, as the magnetic poles S22 and S23 are increased in magnetic force along with the magnetic pole N22, the force which magnetically constrains toner particles becomes excessively high between the magnetic poles S23 and N2, and between the magnetic poles S22 and N3, for example. Thus, the toner becomes solidified between the magnetic roller and magnetic seal, and leaks out. In the case of the test (preferred embodiment 3-3 in Table 3), the scattering of toner began to occur after rough 200,000 prints were made. The characteristic of the scattered toner in this case is that the scattered toner particles are very large in diameter. If large toner particles reach a sheet of transfer medium, they are very conspicuous. Therefore, it is important to prevent large toner particles from reaching a sheet of transfer medium; it is important to prevent the formation of large toner particles.

Next, what occurs as all the magnetic poles of the magnetic seal are reduced in magnetic force will be described with reference to modified version 3-4 of the third preferred embodiment. As all the magnetic poles of the magnetic seal were reduced in magnetic force, the space between the magnetic seal and magnetic roller increased in the number of areas in which magnetic force was weak, as it did in the case of a developing apparatus structured in accordance with the conventional way of technical thinking. Therefore, the magnetic force (toner constraining force) to which toner was subjected reduced. Therefore, toner began to scatter earlier. In the test (Embodiment 3-4 in Table 3), toner began to scatter after the printing of roughly 75,000 copies.

As described above, in this embodiment, the two magnetic seals, which are at the lengthwise ends of the magnetic roller, one for one, are provided with one magnetic pole which is the same in polarity to the mutually repelling magnetic poles of the magnetic roller, in addition to the magnetic poles which a conventional magnetic seal has. Further, the additional magnetic pole is greater in the magnetic flux density in terms of the direction R, than the adjacent magnetic poles (which conventional magnetic seal has). That is, the scattering of toner can be drastically reduced by designing a developing apparatus so that the magnetic pole N2 is greater, in the magnetic flux density in terms of the direction toward the center of the magnetic member 2*f*, than the magnetic poles S22 and S23, which are opposite in polarity to the magnetic pole N2.

This structural arrangement can be applied to the first and second development rollers 2*a* and 2*b*, respectively, of the developing apparatus in the second preferred embodiment, and is effective to drastically reduce the amount by which toner is scattered.

Incidentally, the development condition under which the developing apparatus in this embodiment was tested is only an example. In other words, the development condition is desired to be optimized according to the specifications of an image forming apparatus, and the environment in which the image forming apparatus is operated.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 019776/2009 filed Jan. 30, 2009, which is hereby incorporated by reference.

What is claimed is:

1. A developing apparatus comprising:

a developer carrying member for carrying a developer containing magnetic particles and for developing a latent image formed on an image bearing member;

a magnetic member, provided in said developer carrying member, for magnetic confinement of the developer on a surface of said developer carrying member, wherein said magnetic member has a set of repelling poles including a first magnetic pole and a second magnetic pole which have the same magnetic polarity; and a magnetic seal provided opposed to said developer carrying member at a side remote from said image bearing member;

wherein said magnetic seal has a third magnetic pole having a magnetic polarity opposite to that of the magnetic polarity of the first magnetic pole and disposed at a position closest to a peak position of the first magnetic pole on a surface of said magnetic seal opposing to said developer carrying member, a fourth magnetic pole having a magnetic polarity opposite that of the magnetic polarity of the second magnetic pole and disposed at a position closest to a peak position of the second magnetic pole on the surface of said magnetic seal opposing to said developer carrying member, and a fifth magnetic pole as an only one magnetic pole provided between the third magnetic pole and the fourth magnetic pole, the fifth magnetic pole having a polarity opposite to that of the third magnetic pole and the fourth magnetic pole.

2. The developing apparatus according to claim 1, wherein at the surface of said magnetic seal opposing to said developer carrying member, a magnetic flux density of said fifth magnetic pole is larger than magnetic flux densities of the third magnetic pole and the fourth magnetic pole with respect to a normal line direction of said magnetic seal.

* * * * *